US008269095B1

(12) United States Patent
Wallace

(10) Patent No.: US 8,269,095 B1
(45) Date of Patent: Sep. 18, 2012

(54) MAGNETIC PICKUP RESPONSE MEASUREMENT AND PRESENTATION

(76) Inventor: Henry Burnett Wallace, Fincastle, VA (US)

( * ) Notice: Subject to any disclaimer, the term of this patent is extended or adjusted under 35 U.S.C. 154(b) by 149 days.

(21) Appl. No.: 12/798,215

(22) Filed: Mar. 31, 2010

Related U.S. Application Data

(60) Provisional application No. 61/211,616, filed on Apr. 1, 2009.

(51) Int. Cl.
*G10H 3/18* (2006.01)

(52) U.S. Cl. ..... 84/726

(58) Field of Classification Search ..... 84/726; 381/61

See application file for complete search history.

(56) References Cited

U.S. PATENT DOCUMENTS 4,215,310 A * 7/1980 Schwerer, III ..... 324/225
4,545,278 A * 10/1985 Gagon et al. ..... 84/726
5,029,511 A 7/1991 Rosendahl
6,448,488 B1 9/2002 Ekhaus et al.
7,095,860 B1 8/2006 Kemp
7,184,557 B2 * 2/2007 Berson ..... 381/61
2007/0295195 A1 * 12/2007 Tamura ..... 84/731

OTHER PUBLICATIONS

R.G.Keene, "Guitar Pickup Tester", World Wide Web document, copyright date of 2007, accessed on Jan. 5, 2009, Located at "www.geofex.com/FX_images/Pickup%20Tester.pdf".

S. Errede, "Measurement of the Electromagnetic Properties of Electric Guitar Pickups", World Wide Web document, accessed on Jan. 5, 2009, located at "http://online.physics.uiuc.edu/courses/phys498pom/Lab_Handouts/Electric_Guitar_Pickup_Measurements.pdf".

Stellartone Tonestyler (R), "Stellartone—Home", World Wide Web document, accessed on Mar. 29, 2010, located at http://www.stellartone.com/.

* cited by examiner

*Primary Examiner* — Jianchun Qin

(57) ABSTRACT

The magnetic pickup response measurement and presentation system quickly measures frequency responses of magnetic pickups under various loading conditions, and the data is presented graphically and aurally to the user to aid user comparison and selection of magnetic pickups for use in musical instruments.

16 Claims, 21 Drawing Sheets

MAGNETIC PICKUP RESPONSE MEASUREMENT AND PRESENTATION

PRIORITY

This application claims priority through U.S. Provisional Application No. 61/211,616 filed by Henry B. Wallace on Apr. 1, 2009 for "Guitar Pickup Measurement Method and Data Presentation Method."

BACKGROUND OF THE INVENTION

1. Field of the Invention

The present invention relates to the measurement of frequency responses of magnetic pickups typically used in musical instruments, and the presentation of the collected data to aid user comparison and selection of magnetic pickups.

2. Description of the Prior Art

Electric guitars and basses (or other applicable instrument in all that follows) use magnetic pickups to capture the vibration of the strings for amplification. These pickups consist of a magnetic core or cores with a winding of wire wrapped around. When ferromagnetic strings vibrate in the magnetic field, a corresponding voltage is induced in the winding. Such pickups have been in common use for decades.

Guitarists in particular are keenly aware that the type and construction of the pickup determines to a large extent the sound that will be produced by a guitar. Guitarists select pickups to obtain a certain sound, and the range of pickup choices in the marketplace runs into the thousands.

However, there are some difficulties related to pickup selection. The first is that they are not inexpensive, sometimes costing a hundred dollars or more apiece, and guitars have typically two or three pickups. This limits the guitarist's selection of pickups to whatever he can afford to physically try in the instrument. If the pickups' sound is unsatisfactory, he is faced with the task of selling them as used pickups at a monetary loss.

It also takes an hour or two to install pickups in an instrument, there being a requirement to remove the strings, disassemble some or all of the instrument, solder in the new pickups, reassemble the instrument, and replace the strings. That makes it difficult to do fast A/B comparisons, and subtle differences between two pickups may not be noticed due to the installation delay.

Pickups also sound different in every guitar, being affected by the type of strings and their age, the shape and construction of the instrument, the type of wood, the ambient temperature and humidity. Other factors contribute as well, such as the acoustic space, and even the player's mental state as he plays. This means that a pickup whose sound is recorded after installation in one instrument will likely sound very different in another instrument, or even in a different room, making pickup comparisons difficult.

Another problem is that pickup tone is described in the trade press and manufacturers' advertisements using inexact language, such as "bright", "dark", "woody", etc., and so trade press pickup reviews are almost useless in pickup selection.

What is needed is a way to quickly compare the sounds of pickups apart from the guitar's acoustic characteristics, and apart from other uncontrollable factors. The measurement and presentation methods described here allow such comparisons, and that is the object of this invention.

Heretofore, there has been no easily usable instrument for measuring the responses of magnetic pickups. One prior art device (Keene) consists of a means for mounting a pickup under a set of guitar strings which are vibrated by an excited coil, with the response being observed using test instruments or the human ear. This arrangement has numerous disadvantages. First, the pickup under test must be removed from any instrument in which it is installed. Second, the range of test frequencies is limited to the vibrational range of the strings and mechanical apparatus, and particularly how they are mechanically excited. (Keene does not suspect that there may be signals or sound sources that are more useful and revealing than vibrating strings.) Third, vibrating strings produce harmonics, some of which are coincident with the fundamental tones of higher pitched strings, confusing the interpretation of the measured data. Fourth, metal strings age and tarnish, making consistent measurements over time impossible. Fifth, the measurement device and system is not portable or easy to use when measuring multiple pickups, and is not usable by groups of musicians distributed worldwide. Most importantly, the measurement arrangement does not provide a way to quickly compare multiple pickups to hear how they sound.

Another method of measuring pickup characteristics involves use of electrical engineering lab equipment. For example, Errede discloses an extensive measurement program for characterizing the electrical parameters of pickups such as inductance, resonant frequency, etc. While this information has technical value and does allow numerical differentiation between pickups, it gives no indication to the human ear how two pickups sound by comparison. Musicians do not understand electronics by and large, and rather need a simple sonic or visual comparison of pickup responses.

Musicians do understand that there are several factors that affect how pickups sound. The construction of the pickup is of course primary. Pickups are generally manufactured in two configurations, single and dual coil. Dual coil pickups were invented to cancel the hum produced by proximity to AC power fields. However, they contain more wire and consequently have more internal resistance and interwinding capacitance, and lower resonant and low-pass roll off frequencies.

Musicians also understand that the resistance of the volume control in the instrument also affects pickup response, as does the capacitance of cables used to connect the instrument to any amplifier.

For example, Gagon, et al. (U.S. Pat. No. 4,545,278, Oct. 8, 1985) states, "The result is that the resistive loading on the pickup is increased (by lowering the load resistance seen by this pickup), which causes the resonance peak to be less high and more wide than that illustrated . . . " This invention adjusts the resonant peak of the pickup by adjusting the resistive and capacitive load on the pickup. Generally, the lower the resistance, the lower the Q of the pickup's resonance, which of course changes the sound of the pickup. Increasing capacitance decreases the resonant frequency of the pickup, it being primarily inductive. The invention does not disclose how to measure and display such effects so that the guitarist can hear differences between pickups so loaded.

A commercial product, the Stellartone ToneStyler® uses switched resistances and capacitances to change the response of attached passive pickups.

While musicians understand that these factors have an affect on the sound of a pickup, they do not understand exactly how the sound is affected. The present invention and presentation allows the musician to grasp these complex factors neatly and quickly, without theory or mathematics, allowing them to actually hear and see how the sound of the pickup is affected directly.

Allowing the musician to hear how the pickup sounds, apart from an instrument, requires signal processing methods.

The notion of placing a sound source into various sonic spaces and replicating frequency responses using digital signal processing and modeling is well established. For example, Kemp (U.S. Pat. No. 7,095,860, Aug. 22, 2006) describes a system for capturing and reproducing the response of a level or frequency control device. The intent there is to simulate real or synthesized responses and process audio as if it originated from a system with such a response. That is, there is an audio source, a processing system, and an output audio signal intended for listener consumption, or later use in recording or the like.

Berson (U.S. Pat. No. 7,184,557, Feb. 27, 2007) describes an invention that " . . . relates to reproducing stored audio signals in a manner such that the reproduced signals sound as if the stored audio signals had been recorded in a particular acoustic environment." In fact, there is a well-developed technology base of modeling software and hardware available to musicians that performs just this task. Here again, there is an audio source, a processing system, and an output audio signal.

Ekhaus, et al. (U.S. Pat. No. 6,448,488, Sep. 10, 2002) describes a processing system for musical instrument transducers that can make the instrument sound like a different instrument: "The resynthesized output signal be a microphone output signal, may have acoustic characteristics of another [stringed musical instrument] or possess acoustic characteristics of a "theoretical" [stringed musical instrument]." Here again, there is an audio source (a musical instrument), a processing system, and an output audio signal, possibly sounding like and entirely different musical instrument.

These methods involve creating audio that one might reasonable expect to hear in a certain environment, while in actuality the audio originated in some other environment, or from another instrument of similar type, such as a guitar. The net result and intention of these inventions is presentation of audio to a listener while striving for genuine and believable sound. Even in situations where the implied audio source and environment are not commonly associated, the inventions strive to convince the listener of the reality of the combination. For example, one does not typically hear a symphony in the acoustic space of a concrete stairwell (not the least reason being the physical space required), but the goal of the prior art methods is to get the listener to comment, "That sounds like a symphony orchestra in a stairwell." The modeling and processing methods do allow new combinations of sources and spaces, but the end product is always the result of processing an audio program source with a certain response, and listening to that result alone.

The present invention has a different goal regarding modeling and aural presentation, that being the comparison of two pickup responses by graphical display and also the playing of audio clips through electronically measured pickup frequency response curves. Typically, a musician has a certain set of pickups in an instrument, and he knows intimately how those pickups sound because he has spent many hours playing that instrument. If he is dissatisfied with the pickups, he will generally know in what direction he desires to change his sound. For example, he might want more high frequency content. Comparing his existing, well-known pickups with others with which he is unfamiliar allows him to quickly determine whether the candidate pickups reflect the change in character that he seeks. In this case, the actual audio clip(s) selected to be processed through pickup frequency responses is not very important, and could be guitar music, but could as well be a prerecorded song, white noise, speech, or any other source having spectral content that illuminates differences between two pickup responses. While the technical methods used to process the audio are similar to prior art methods, the ultimate goal is quite different, that being the rapid comparison of frequency responses. The audio as processed according to the responses need not be 'believable', in the sense outlined above, and in fact may not even be related to the music typically reproduced by magnetic pickups.

Musicians are also eager for systems and methods that allow multiple tonalities to be had from one instrument, and as a result inventions exist to accomplish this. For example, Rosendahl (U.S. Pat. No. 5,029,511, Jul. 9, 1991) describes as system for easily exchanging pickups in guitars. This allows the musician to more quickly change pickups and experiment with the sounds that different styles and brands of pickups create. However, the musician must be in physical possession of the pickups so tested, and this is an expensive proposition. And while changing the pickups with such a system is faster than disassembling the instrument, it still takes considerable time as the strings have to be either removed or slackened. Thus it is impossible to do fast A/B comparisons of two pickups. Such systems that allow modular pickup replacement are by far in the minority.

Objects and Advantages of Magnetic Pickup Response Measurement and Presentation Several objects and advantages of the magnetic pickup response measurement and presentation methods are:

1. Comparison of pickup responses is a quick and easy task, not requiring any modification of the instrument.
2. Pickup responses may be stored in a database for online access, allowing users worldwide to compare pickups that they do not even own.
3. Pickup responses may be compared graphically and aurally.
4. The responses of several pickups may be compared quickly using predetermined selectable, or user uploaded audio clips, eliminating the delay required for physical A/B comparisons.
5. Pickup responses may be measured under various loading conditions, and those responses used to create graphical or aural comparisons.
6. Pickup responses measured and stored and reproduced in this way are not affected by the structure, condition or temperature of the stringed musical instrument, the type of strings, or other factors not directly related to the pickups.
7. Pickup responses may be measured with the pickup wired into an instrument, or outside an instrument.
8. Measurement of pickup responses can quickly be performed by minimally trained personnel using an inexpensive handheld instrument, requiring no laboratory grade equipment.
9. Additional factors may be measured and presented, such as electrical and magnetic pickup parameters.

SUMMARY OF THE INVENTION

The present invention quickly measures frequency responses of magnetic pickups under various loading conditions, and the data is presented to the user to aid user comparison and selection of magnetic pickups.

DETAILED DESCRIPTION

The invention consists of two aspects, easy pickup response measurement, and presentation of the measured responses in a useful way, graphically and aurally.

To measure pickup responses it is required to stimulate the pickups magnetically in a way similar to vibrating strings, but without all the attending variability. The vibrating string disturbs the magnetic field of the pickup, producing a varying voltage in the pickup coil. A small, varying magnetic generated by an excitation coil or coils is suitable for stimulating the pickups magnetically, while measurement apparatus connected to the pickup coil determines the amplitude of the resulting voltage, recording that information.

Excitation Coils

Figure 1:
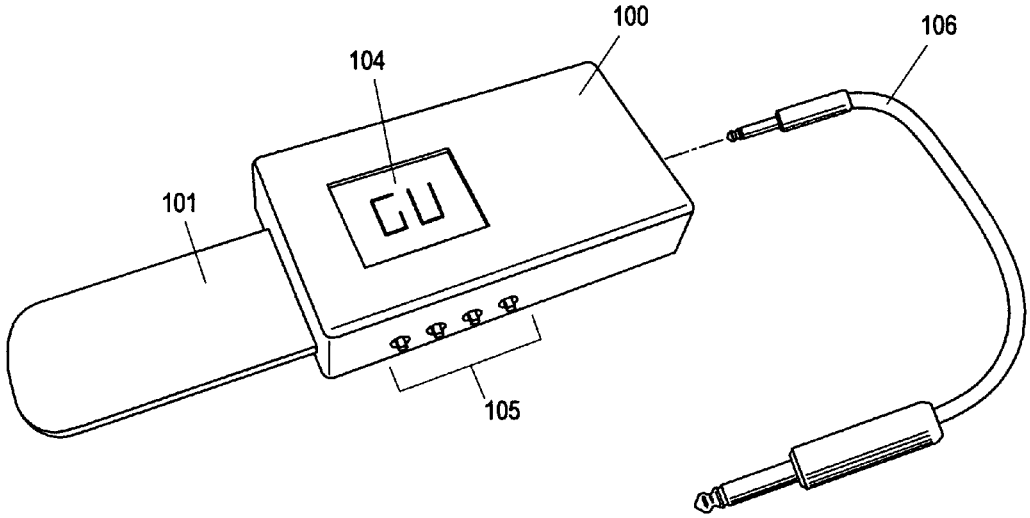
FIG. 1 is a sketch of a handheld pickup measurement device and connecting cable.

FIG. 1 shows a sketch of a handheld device that performs this task. The unit consists of a small plastic box 100 and a flat printed circuit board protrusion 101 that contains the excitation coils (not shown in this view). The protrusion is covered by a polyolefin film to protect it from scratches and keep it from scratching the instrument or pickup being measured. The device has an LCD 104 that provides user feedback, and a keypad 105 to accept user input. The device also connects to a musical instrument through a two conductor shielded cable 106, made preferably short to minimize the effects of cable capacitance, or optionally using a driven shield approach to reduce the cable capacitance to near zero. If a pickup is being measured outside an instrument, then the cable is terminated in clipleads to allow easy connection (not shown).

Figure 2:
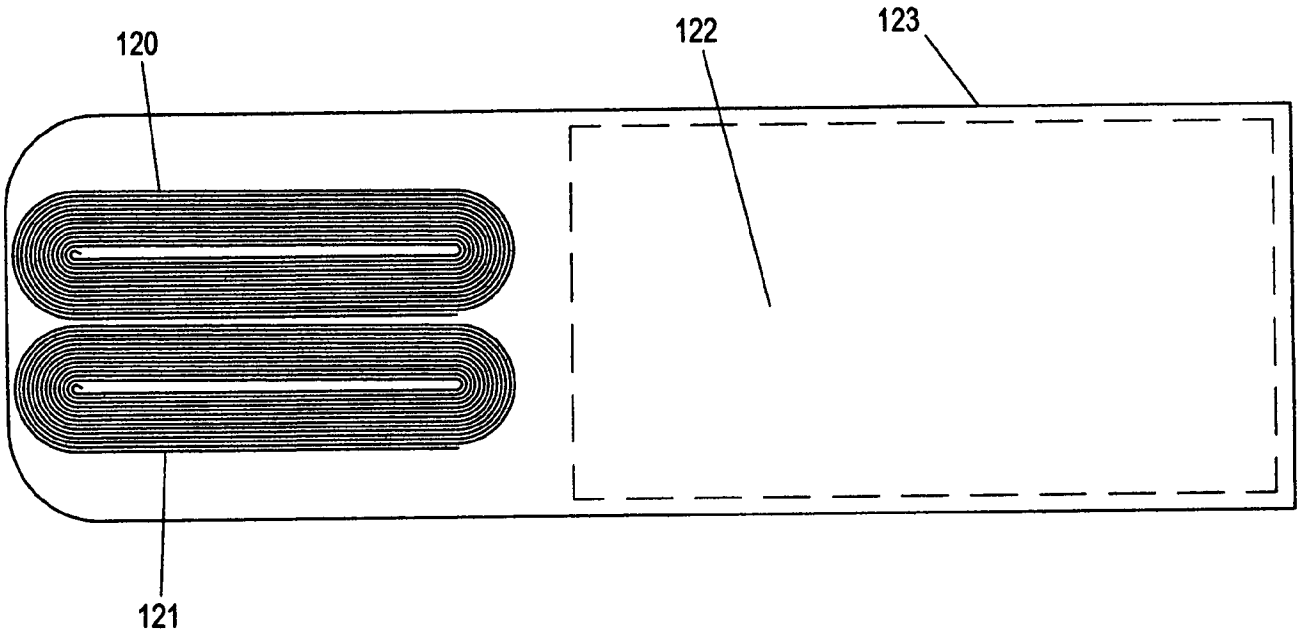
FIG. 2 shows the excitation coil used to measure pickup frequency responses.

Examining the printed circuit board 123 of the handheld device in FIG. 2, the excitation coils 120 and 121 are immediately obvious. These single layer spiral coils are driven with a current corresponding to the excitation signal, in the case of this measurement device a sinusoid, but the excitation signal could as usefully be broadband noise of a known characteristic. When these coils are placed in proximity to the pickup under test, they induce a magnetic field in the coil of the pickup corresponding to the excitation signal.

However, the design of the excitation coils is important. There should be an air or non-ferromagnetic core therein to avoid hysteresis effects and also to avoid changing the inductance of the tested pickup. The excitation coils should be low in inductance and internal capacitance with respect to the pickup to avoid skewing the frequency response of the tested pickup. And the excitation coils must be thin, in order to be insertable between the strings of a guitar and any of its pickups. The excitation coils must also not couple capacitively to the tested pickup's windings, to avoid changing the frequency response. All these design goals are satisfied by the design indicated in FIG. 2.

Such a coil can be made inexpensively and durably using a circuit board trace. Each coil 120 and 121 has an inductance of 38 microhenries (uH) in this embodiment, much smaller than the pickup inductance of typically several Henries. The capacitance of this coil to the pickup (not shown) is only some few picofarads and is not significant, and the internal capacitance of the coils 120 and 121 is negligible at audio frequencies. The coils 120 and 121 are shaped to match the profile of most guitar pickups, to maximize magnetic coupling. For testing single coil pickups, one coil is energized, for example, coil 120. For testing dual coil pickups, both driver coils 120 and 121 are energized with the same current (by connecting them in series). The remainder of the circuitry 122 to the right of the coils performs measurement and user interface functions. This entire circuit board is 17.8 cm long and 5.5 cm in height, and 0.25 cm thick with the protective covering over the excitation coils.

Figure 3:
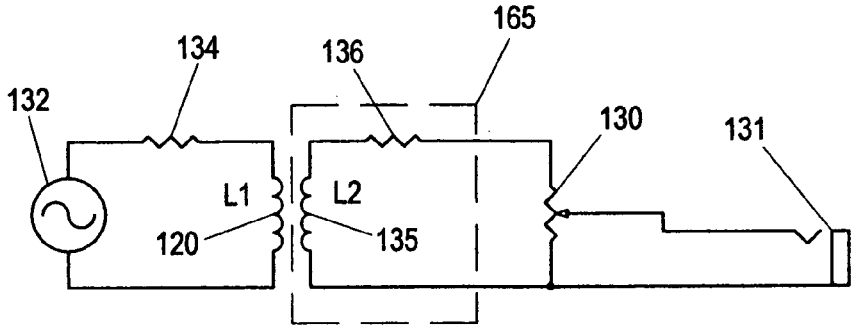
FIG. 3 is a schematic representation of the equivalent circuit of the magnetic pickup installed in an instrument, being excited by the excitation coil in the handheld pickup measurement device.

The mutual inductance between the excitation coils and the pickup requires some analysis to ensure we are measuring the frequency response of the pickup properly. Refer to the circuit in FIG. 3. The inductor 120 is the excitation coil (assuming a single coil drive for the sake of discussion and without loss of generality), a circuit board trace as shown in FIG. 2, also labeled L1. A pickup 165 is modeled by an inductor 135 (also labeled L2) with an internal resistance 136, shown in the dashed box. (The distributed capacitance of the pickup coil is not shown but is assumed to be present in all that follows.) The instrument volume control potentiometer 130 and audio jack 131 are part of the guitar circuitry. An AC voltage source 132 is used to pump a current through the excitation coil 120 in conjunction with a current limiting resistance 134.

(Note that guitars and basses typically contain tone controls, which are generally a potentiometer connected as a variable resistor in series with a capacitor. This series combination is connected across the pickup to variably reduce high frequency response. All analysis herein assumes that the tone control is set to maximum resistance so that the capacitor has little or no effect on the response of the pickup. To that end, such a tone control is not shown in the figures.)

As for component values, the voltage source 132 typically runs at 1V RMS. The current limiting resistor 134 is typically 22 ohms. The inductor 120 measures 38 uH, as constructed. Guitar pickups measure typically several Henries of inductance, with a resistance 136 of between 1K and 15K ohms. The volume control 130 is typically 250K to 500K ohms. Values of pickup and instrument components can vary out of this range without negatively impacting the performance of the measurement technique.

What is needed is to determine if the measurement method affects the frequency response plot. The mutual inductance between the two coils is important, and allows us to construct an equivalent circuit for analysis, shown in FIG. 4. This equivalent circuit for magnetically coupled coils is well known to practitioners of circuit analysis.

Figure 4:
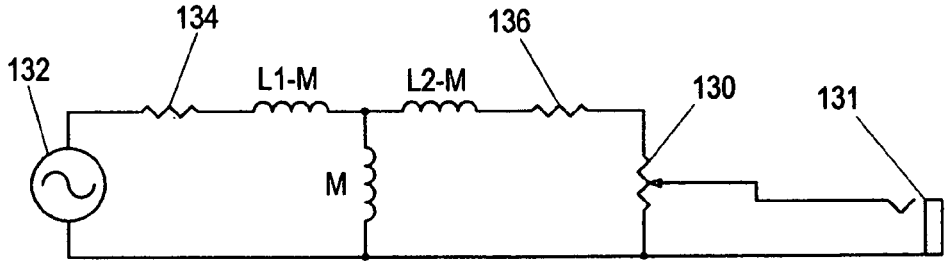
FIG. 4 is a schematic representation of the equivalent circuit of the magnetic pickup installed in an instrument, being excited by the excitation coil in the handheld pickup measurement device, with the magnetically coupled coils decomposed into an equivalent circuit.

The mutual inductance between the driver and pickup coils is labeled M on FIG. 4. The formula for M is $$M=k\cdot sqrt(L1-L2)$$

where k is the coefficient of coupling (0<=k<=1), and sqrt is the square root operator. The other two coils have inductances of L1-M and L2-M as labeled on FIG. 4.

An analysis of this circuit reveals that the small value of 38 uH for the inductance of the excitation coil introduces a linear 20 dB/decade positive slope in the 10 Hz to 20 KHz frequency range, when the coefficient of coupling is approximately k=0.5 (as estimated from an actual measurement). This slope is compensated for by mathematically applying a complementary −20 dB/decade slope to the collected data, resulting in the actual frequency response curve of the guitar pickup when stimulated by an external varying magnetic field, or disturbances in a static magnetic field caused by a vibrating ferromagnetic string.

Using this coupling method, it is possible to excite the excitation coils with a sinusoidal or noise source and determine the frequency (and phase response, if required) of the pickup in or out of the instrument. It matters not whether there are strings on the instrument, or whether the pickup is mounted in an instrument at all because none of those factors affect the magnetic field near the pickup and excitation coils. (The value of the potentiometer in the instrument is important, and a measurement of its resistance is described below.)

Humbucking pickups have two coils and are constructed so that they cancel power line hum from external sources. Such pickups sense the string's vibration with both coils. In that case, both excitation coils 120 and 121 are used, with the same current flowing through each excitation coil, with a phase matching the pickup under test. All the other principles of operation are the same as described above.

Pickup Loads

Figure 5:
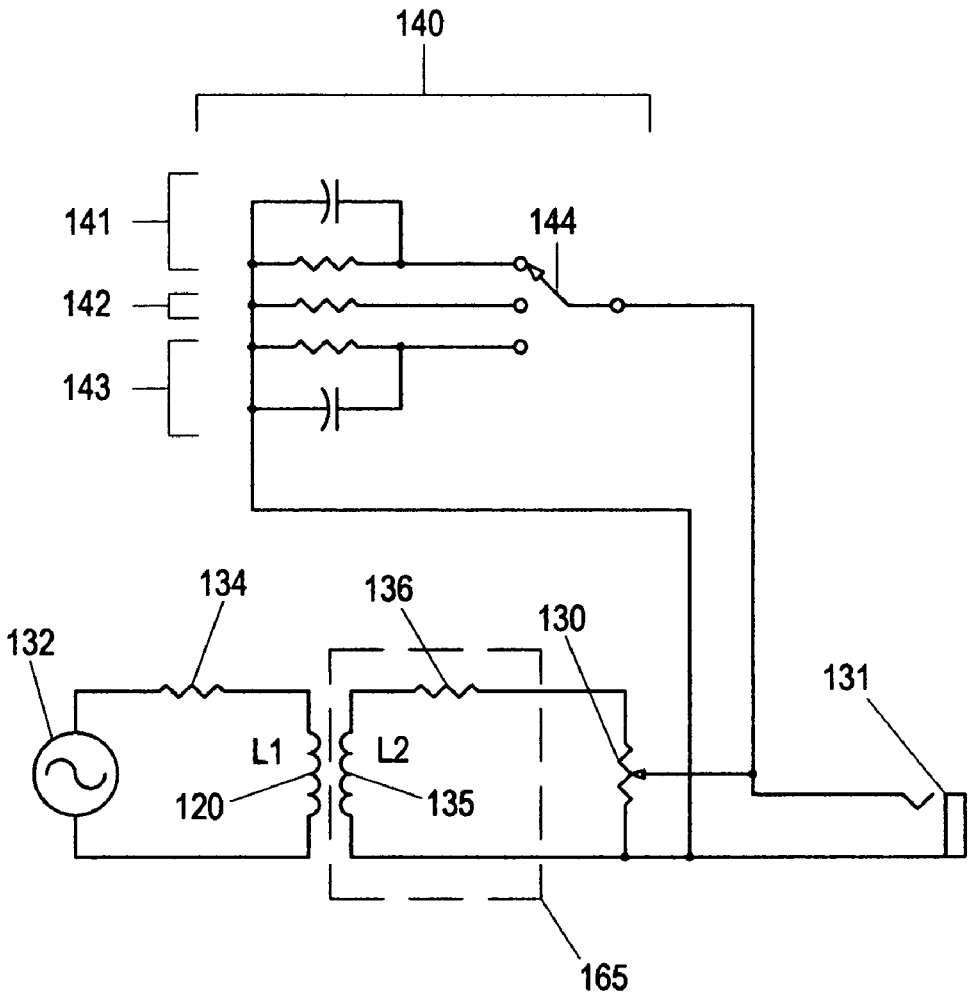
FIG. 5 is a schematic representation of the equivalent circuit of the magnetic pickup installed in an instrument, being excited by the excitation coil in the handheld pickup measurement device, with selectable load circuits attached to the pickup to simulate various cable and amplifier impedances.

The measurement device can also simulate various loads that a guitar or pickup might be subjected to in the course of use, such as various amplifier input impedances, and various cable capacitances. Multiple curves can be recorded under these conditions to give a guitarist a curve taken in conditions similar to what he uses. For example, the circuit of FIG. 5 shows the circuit of FIG. 3 with the addition of a switchable load 140 connected. As noted in the prior art, resistive and capacitive loads on a magnetic pickup change its gain and resonance characteristics. Multiple loads 141-143 may be switched in during testing with a switch 144 to evaluate such situations. These loads are typically various resistance values from 100K ohms to 1 MEG ohms, and capacitances from zero added capacitance, to several nanofarads as would be contributed by a long passive shielded signal cable. The load may be connected directly to the pickup under test (as shown for brevity) or to the instrument's audio jack externally.

A control signal 144 for the switchable load 140 comes from the control circuitry for the handheld measurement device, typically a microcontroller.

Excitation Coil Positioning

Figure 6:
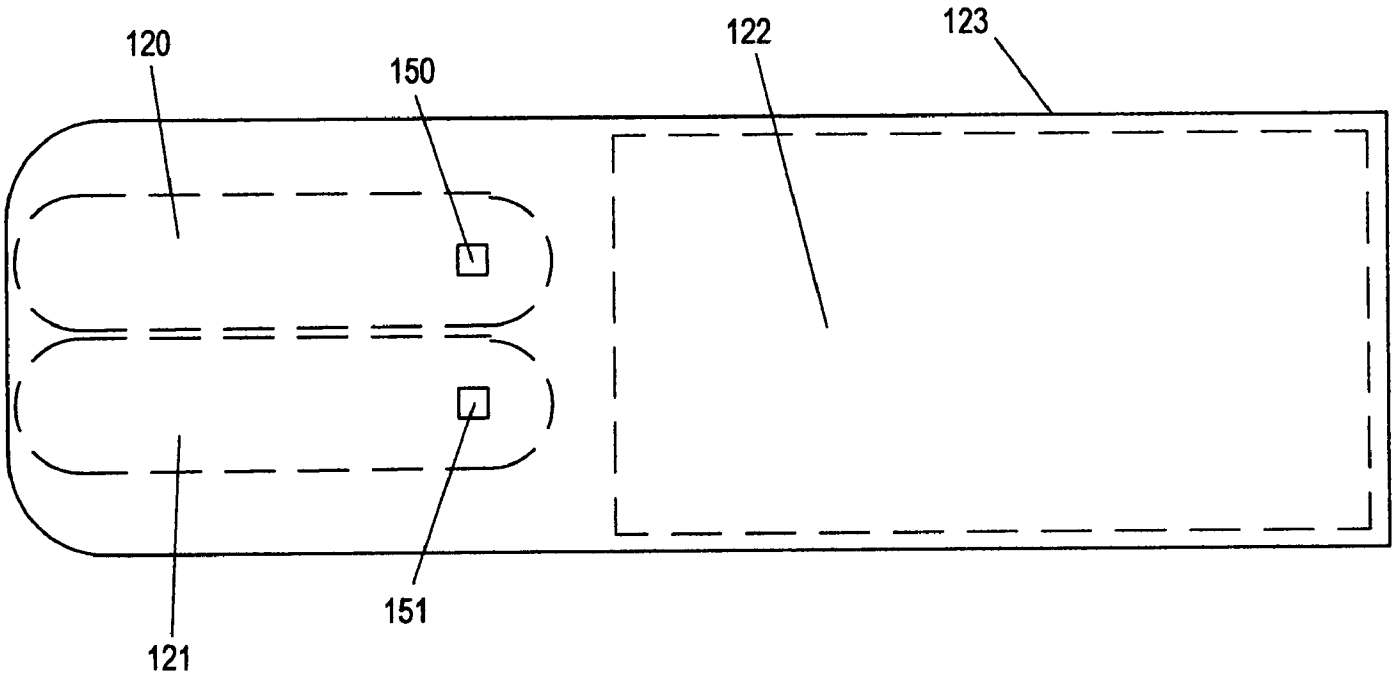
FIG. 6 shows the excitation coil used to measure pickup frequency responses and magnetic sensors mounted thereupon.

Refer to FIG. 6. To assist the operator in the positioning of the excitation coils 120 and 121 (shown partially), magnetic sensors 150 and 151 are situated at the end of each coil on the side of the circuit board 123 away from the pickup surface. (Excitation coils 120 and 121 are disposed on the side of the circuit board 123 closest to the pickup for best magnetic coupling.) Each sensor 150 and 151 senses the static magnetic field from the pickup (through and perpendicular to the surface of the fiberglass circuit board 123) and is used to generate a field strength indicator on the LCD 104 to assist the operator in positioning the excitation coils for optimum measurement. The placement of each magnetic sensor along the centerline of each excitation coil is not critical because the magnets in pickups are typically distributed along the centerline of each pickup coil. The sensors are also very small and do not significantly disturb the magnetic field of the excitation coils.

The two magnetic sensors 150 and 151 are used to detect whether the pickup is a single or double coil model, and automatically energize one or both excitation coils 120 and 121 during testing. The sensors indicate the polarity and relative strength of the magnetic field of the pickup magnets, and this information is recorded for later presentation. Stronger magnets typically provide more audio output from a pickup, and this is a factor that guitarists use in consideration of competing pickup models.

Since the measurement device generates and measures the level of audio signal produced by the pickup, it is also possible to use that as an indicator to aid the operator in positioning the testing means for optimum measurement, where he attempts to maximize the level by adjusting the position of the excitation coil array.

Fortunately, the positioning of the excitation coils is not very critical, and even several millimeters of misalignment produces a good frequency response plot.

Measuring Resistances

Two of the factors determining pickup frequency response are the resistance with which it is loaded, and the DC resistance of the pickup itself. See FIG. 7. The load consists of a volume potentiometer 130, typically 250K ohms to 500K ohms, and a guitar amplifier's input resistance (not shown), typically 1 MEG ohm. Pickup 165 DC resistance 136 typically varies from 1K ohms up to 15K ohms.

Measuring the guitar potentiometer and pickup resistances is important and can help explain the cause of frequency response details. Also, guitarists are used to comparing DC coil resistances of pickups to get an idea of the relative voltage output, with higher resistances corresponding to higher output voltages. A method is presented here that can quantify these two resistance values without disassembling the instrument, assuming the pickup is mounted inside an instrument.

Figure 7:
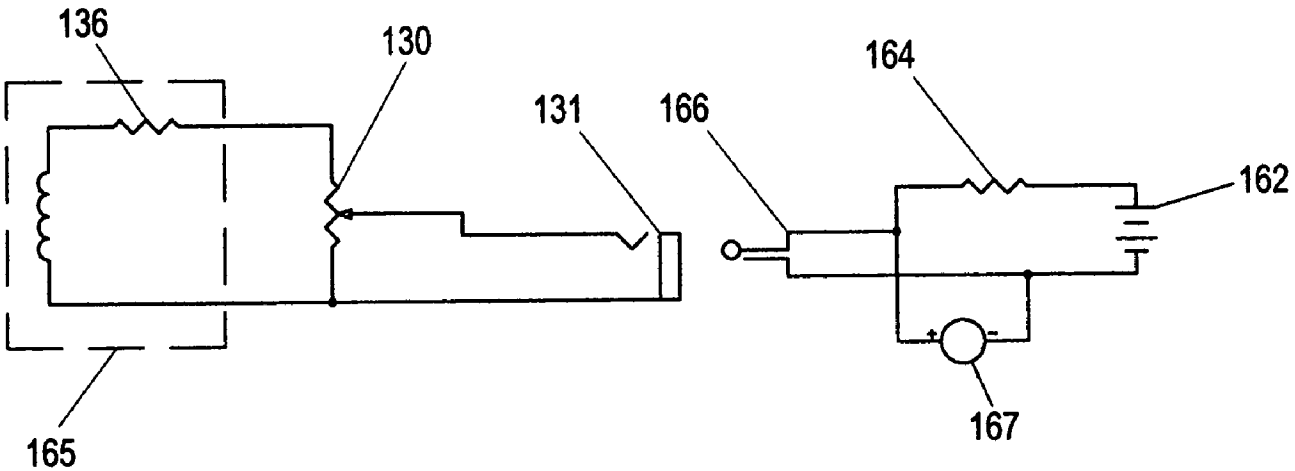
FIG. 7 is a schematic showing the measurement method of the pickup's and the instrument's potentiometer DC resistance.

Referring to FIG. 7, a low voltage DC source 162 is connected to the guitar's audio jack 131 through a fixed resistor 164 and an audio plug 166. A DC voltage of 3.3V for DC source 162 and a fixed resistor 164 of 27K ohms are used typically.

A voltmeter 167 is connected as shown, and the guitar's potentiometer 130 is rotated by the operator to obtain the maximum voltage. The parallel combination of, the potentiometer 130 and guitar pickup resistance 136 causes the maximum voltage to occur at some mid-rotation position of the potentiometer 130.

This maximum voltage is recorded by a microcontroller typically and from it is computed (using Ohm's Law) the maximum resistance, RH, using the DC source 162 voltage and resistance 164. The potentiometer 130 is then rotated to the maximum volume setting, the voltage 167 is once again recorded, and from it is computed the minimum resistance, RL, using the DC source 162 voltage and resistance 164. Those values permit computation of the pickup and potentiometer resistances.

For example, assume the DC source 162 voltage is Vs=3.3 VDC, and the resistance 164 is R=27K ohms, and the maximum voltage measured with the voltmeter 167 is V=2.4 VDC. Resistance RH is computed as RH=V·R/(Vs−V)=2.4V·27K/(3.3V−2.4V)=72K ohms.

Then the potentiometer 130 is rotated to the maximum volume setting, and the voltage measured with the voltmeter 167 decreases. Again, assume the DC source 162 voltage is Vs=3.3 VDC, and the resistance 164 is R=27K ohms. The voltage measured with the voltmeter 167 is V=1.0 VDC. Resistance RL is computed as RL=V·R/(Vs−V)=1.0V·27K/(3.3V−1.0V)=11.7K ohms.

With these two computed resistances (RH and RL), the following formulas yield the resistances of the potentiometer 130 and pickup:

$$R\text{pot}=2\cdot(RH+sqrt(RH\cdot RH-RH\cdot RL))$$

$$R\text{pickup}=4\cdot RH-R\text{pot}$$

where the pickup resistance is Rpickup, and the potentiometer 130 resistance is Rpot.

Continuing with the numerical example using the above formulas, Rpot=276K ohms, and Rpickup=12.2K ohms.

Note that rapid motion of the potentiometer 130 causes the pickup voltage to vary due to its inductive nature, which generates a back EMF. It is necessary to move the potentiometer slowly to get accurate measurements. The display on the measurement device assists the operator by displaying numerically or graphically the maximum voltage (or a number proportional to it), and also prompts him when to increase the potentiometer 130 to the maximum setting.

If measuring a pickup not installed in an instrument, then determination of the pickup resistance is done easily with Ohm's Law using the DC source 162, voltmeter 167, and resistance 164. The potentiometer does not exist in that case.

If the guitar is fitted with an active pickup system (with a built-in amplifier), it is not possible to make the resistance measurements because of the isolation afforded by the amplifier. However, the pickup(s) frequency response(s) may still be measured by this method and equipment.

Storage of Response Data

All the data measured by the measurement device is stored in an internal nonvolatile memory capable of holding many measurements for later recall through a computer interface such as RS-232, logic-level serial, USB, or Bluetooth.

Since many pickups may be measured in one testing session, the measurement device may be fitted with a voice notepad (solid state speech storage) for audibly recording the details of the pickups and instruments, such as model and serial numbers. Also, inclusion of a digital camera aids record keeping through taking of pictures of the pickups and instruments tested. Such pictures are useful during presentation of the data so the user can understand the visual appearance of the tested pickups and source instruments.

The data stored by the measurement device should preferably be encrypted and marked with an authentication method to prevent falsification. Data extracted from the measurement device can then be transmitted over a network and validated at the remote endpoint before presentation. This allows multiple measurement devices to be deployed worldwide, and the data validated and collected in one central database for presentation.

Presentation of the Responses

The collected data is useful only insofar as it is presented in a clear way such that the user can compare pickup responses quickly and easily, without technical background. The data is of such a character that it does not tell the guitarist exactly how a certain pickup will sound in a certain instrument, because each instrument is different. However, the data collected tells the guitarist how one pickup sounds as compared to another (in the same instrument), and that information is sufficient to assist a guitarist in pickup selection.

For example, a common question is, "I have Brand X pickups in my guitar now, so how will Brand Y pickups sound?" A guitarist can easily compare the sound of his existing pickups using the data collected with these methods. That comparison helps the guitarist narrow down the set of candidate pickups, given his desire for a certain sound as compared to his current pickup complement.

Audibly comparing the sound of various pickups is possible if we can play audio through the pickup response as if it came from the strings of the instrument. To do this, we take the measured pickup response and filter one or more reference audio clips with it. Various filtered clips can then be played in rapid succession to hear the difference in pickup sounds for pickups of interest.

This filtering is accomplished using standard digital signal processing methods. For example, the reference clip is converted to the frequency domain using the Fast Fourier Transform (FFT). That data is multiplied by the frequency response magnitude curve for a certain pickup, and then converted back into the amplitude domain. Thus the guitarist has instant access to the sounds of potentially hundreds of pickups.

This method allows a guitarist to quickly compare pickups that he knows, that is, pickups he has played, with pickups he is unfamiliar with. The comparisons inform the guitarist's decision of which pickups to buy and also what components to us in conjunction with those pickups, for example, signal cables.

It is also possible to graph the frequency responses of various pickups and compare them visually. Such a plot reveals variances in the frequency responses and overall audio amplitudes of the pickups. The pickup audio amplitudes are important because frequency response and audio amplitudes are related. The more turns of wire a pickup contains, the louder it will be, but more wire also reduces the high frequency response due to increased resistance, inductance and interwinding capacitance. A graphical plot reveals this relationship neatly. Some guitarists also demand high audio amplitudes for the music they play.

Since we use a set of selectable reference audio clips, and all pickups are measured using the same methods, all pickups are compared under identical conditions. However, it may be desirable for the user to specify a certain reference audio clip, say, of him playing a familiar passage. In this way, a guitarist can make an even more informed pickup decision. A user could, for example, upload an audio clip to a networked server where the server filters the clip according to selected pickup responses, or this filtering could be done in browser or other client software without upload to a server. The resulting filtered clip would then be played back to the user.

It is also beneficial to use more than one reference audio clip, corresponding to various musical and playing styles. The user can select the prerecorded audio clip he desires to use.

The filtering of the audio clips according to the pickup responses can be done in a batch offline or in real time as the user demands or resources allow. The filtering process is not time consuming on modern processors and the audio clips are preferably only a few seconds long to allow quick comparisons of multiple clips and pickups.

Figure 8:
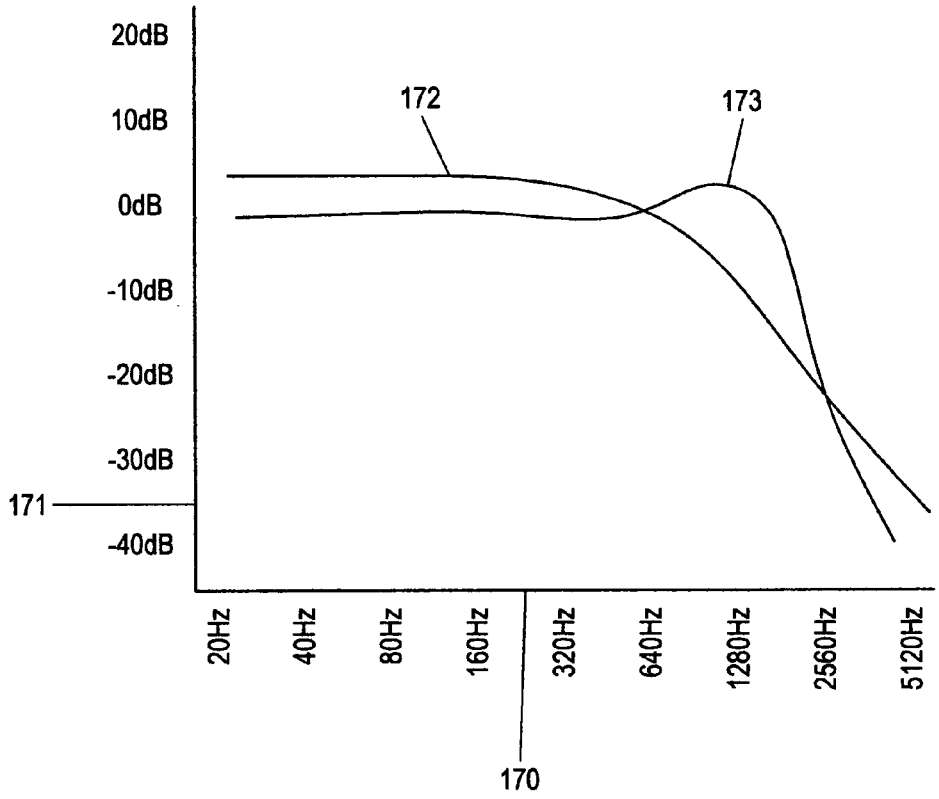
FIG. 8 illustrates how pickup responses from different pickups may be displayed graphically for comparison.

FIG. 8 illustrates how pickup responses may be displayed graphically for comparison. This format appears from a World Wide Web page that has been developed. The user selects one or two pickups of interest using a standard web selection control (not shown), clicks a "Get Pickup Info" button (not shown), and a graph is displayed. This graph shows a frequency response curve or curves 172 and 173, plotted on a log-log set of axes. The y-axis is labeled in decibels, and the zero decibel point is relative to the excitation of the measurement device. Since positioning of the measurement device is much the same for each pickup measurement, curves can be compared to determine relative pickup output and sensitivity levels. The x-axis represents audio frequency. Guitarists are used to looking at such response curves from their experience with amplifiers and microphones, so this is not too technical for their understanding.

In the sample plot shown in FIG. 8, it is apparent that the pickup represented by the curve 173 has a peaking response near 1280 Hz, and that the pickup represented by the curve 172 has a drooping high frequency response, and will have less high frequency output than the other pickup, while having an overall higher output level at low frequencies.

Each type of curve displayed has meaning to various musicians, depending on the type of music they play. For example, a player of country music would gravitate toward the pickup represented by the curve 173 since it has an accentuated high-end response. The other curve 172 would attract guitarists who use heavy distortion because the pickup would not produce unwanted high frequency artifacts. It takes only a few minutes for a guitarist to become familiar with the presentation format to understand how to interpret the curves, especially when he can immediately listen to sound clips representing each curve.

Figure 9:
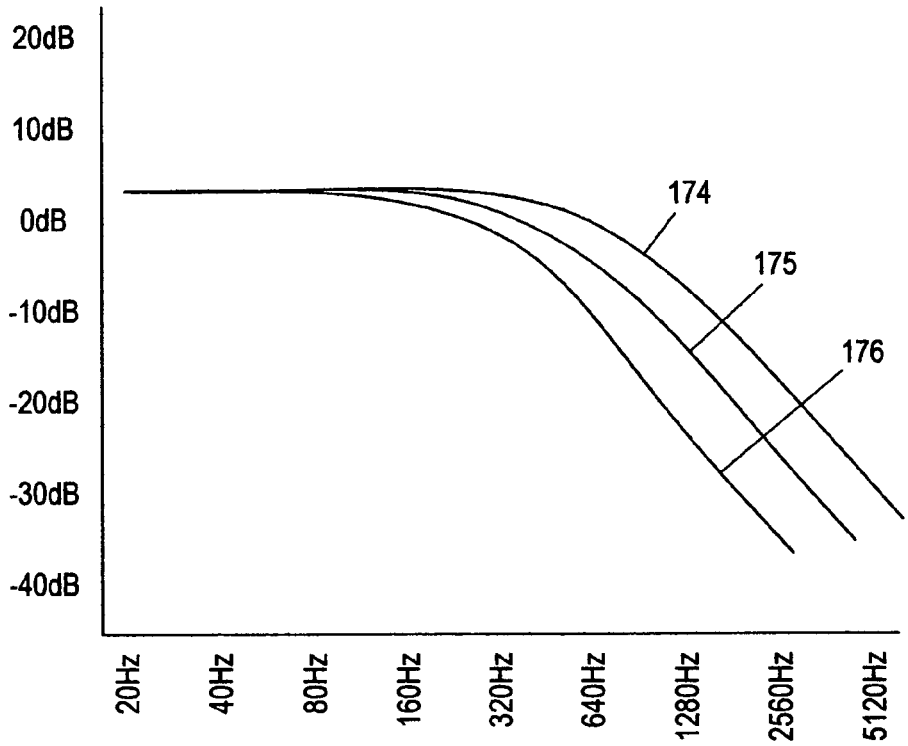
FIG. 9 illustrates how pickup responses from the same pickup may be displayed graphically for comparison.

Shown in FIG. 9 is a set of three curves (174, 175, and 176) from one pickup, but measured using different loads. It is apparent here that various loading conditions produce varying frequency responses. The user can employ such information, and the attending filtered audio clips, to understand exactly how the loads affect the way the pickups sound. This is important because guitarists will sometimes change the values of potentiometers or other components in their instruments, and they need a way to know how this will affect the sound of the pickups, preferably without having to rewire the instrument multiple times. These three curves are representative of varying capacitive loads caused by differing lengths of guitar cable, and would assist a guitarist as well in selecting the proper cable to get the sound he desires with a certain pickup.

In any web interface that presents this information, there would be "Listen" links to play filtered audio clips, and selection mechanisms to choose the pickup loading conditions of interest, including resistance and capacitance levels, possibly communicated in terms of cable lengths. Also, a web interface would preferably present photos of the selected pickups to assist the guitarist by showing him what the pickups look like, and provide an audit trail showing the instruments from which the measurements were taken. All data measured about each pickup is displayed for user consumption, including resistances and relative magnetic field strengths and polarities.

Preferred Embodiment

Figure 10:
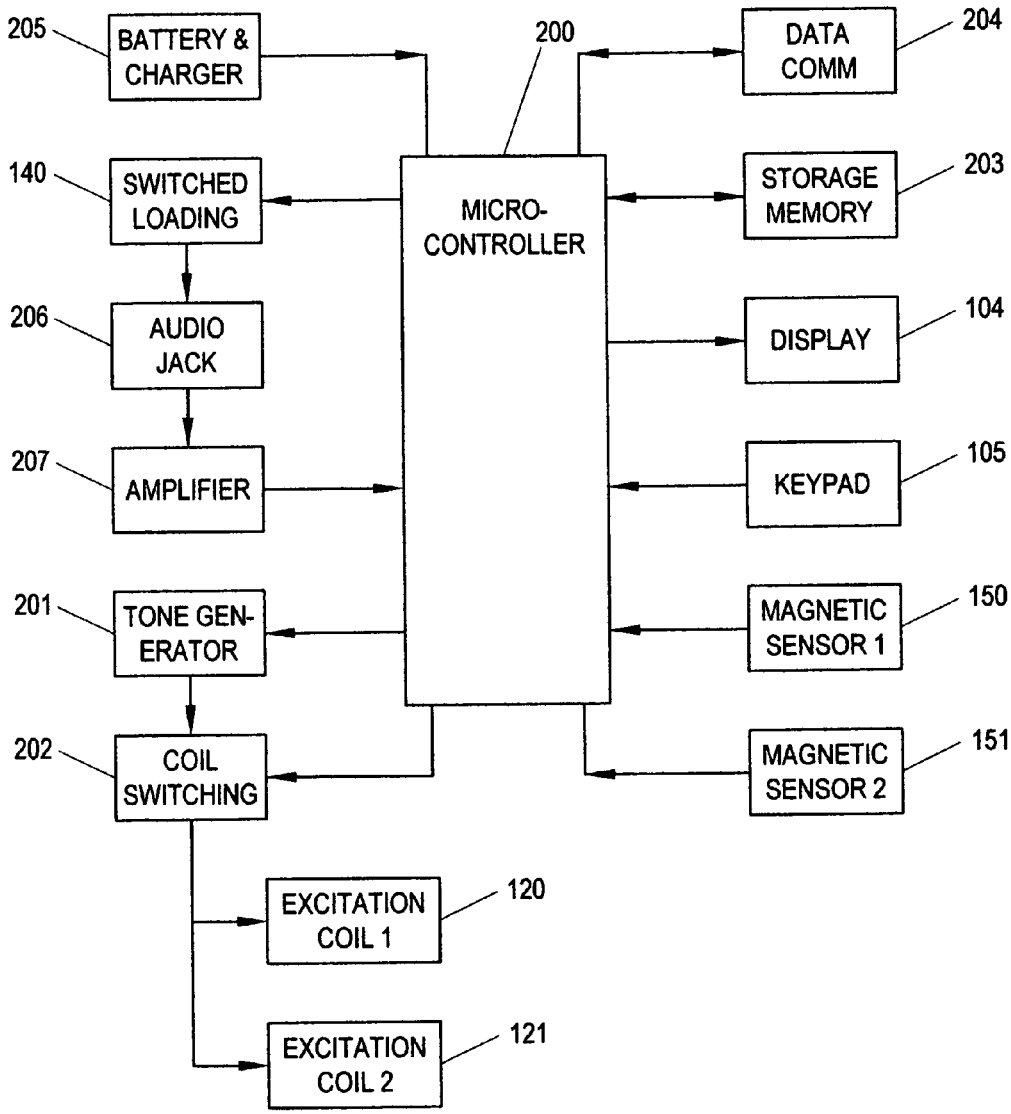
FIG. 10 illustrates the block diagram of the handheld pickup measurement device.

FIG. 10 shows the block diagram of the preferred embodiment. The measurement device is controlled by a microcontroller 200.

To perform a test, the operator first connects the measurement device to the pickup, or instrument containing the pickup. Preferably, the measurement device has an audio jack 206 disposed upon it to allow connection of a cable with a connector compatible with the instrument, or a cable with clip leads suitable for making connections to a pickup not having a connector.

After connection, the operator uses a keypad 105 to select the measurement conditions, such as whether the pickup is being measured within or outside of an instrument (to know whether to attempt to measure the instrument's potentiometer resistance), whether the pickup system is active or passive (active systems requiring no measurement of pickup or potentiometer resistance), which memory location to store the collected data in, and when to start the test procedure. These settings are displayed on the LCD 104. For example, when in-instrument test mode is selected, the display reads "GU" (guitar), and otherwise "PU" (bare pickup). The active/passive nature of the pickup under test is indicated by "AC" or "PA", respectively. One of the selections on the menu is "PO", selecting power off of the device, which turns off all peripherals and the display while saving all stored data.

The magnetic sensors 150 and 151 are used to position the measurement device optimally over the pickup under test. To accomplish this, visual feedback is given to the operator through the LCD 104. When the position is optimized (magnetic field strength has peaked for some time), the microcontroller 200 proceeds with the tests automatically.

During measurements, the microcontroller 200 activates a tone generator 201 to generate a sinusoidal waveform at a selectable frequency and amplitude. This waveform is selectively routed to the excitation coils 120 and 121, depending on which magnetic sensor 150 and 151 is sensing a magnetic field from the pickup under test. Each coil whose associated magnetic sensor senses a magnetic field is driven with the signal from the tone generator, using a coil switching block 202, and with such a phase as to maximally excite the pickup under test (in the dual coil case).

The resulting signal from the pickup under test is routed through the audio jack 206 to an amplifier 207, which amplifies the signal to such a level that is compatible with the analog to digital converter (not shown) in the microcontroller 200. The measurements can be performed using an analog to digital converter of 12-bit resolution or more. (Note that audio filtering according to the measured responses is not limited by this bit depth, and such filtering should preferably be done at a high fidelity bit depth.)

The microcontroller 200 takes the data from the analog to digital converter and computes the amplitude (and phase if desired for other embodiments) of the pickup output signal, storing it in a data storage memory 203. An amplitude measurement is taken for each frequency that tone generator 201 is tuned to. The measurements may be peak or RMS as long as all measurements are taken using the same method.

Alternatively, the tone generator could be replaced with a broadband noise source. In that case, the microcontroller 200 would capture a sample of the pickup output signal from amplifier 207 and perform a spectral analysis to determine the response of the pickup, and then store that in memory 203.

To test the pickup under various loading conditions, a switched loading circuit 140 is provided. The microcontroller 200 selects which load is connected during the test, and performs successive tests with multiple loads in sequence, saving the data for each test in memory 203, properly labeled with the test conditions. The schematic of FIG. 5 shows only three loads in the load circuit 140, but in actuality any reasonable number of loads may be configured in the measurement device.

Once data has been collected and stored in memory 203, this data may be communicated to other systems by microcontroller 200 through a data communication interface 204, typically a RS-232, logic-level serial, USB, Bluetooth or other type interface including removable memory.

A rechargeable NiMH battery and charging circuitry 205 is included to power the measurement device.

FIGS. 11-21 are a schematic representation of the circuit of the preferred embodiment of the handheld pickup measurement device.

Figure 11:
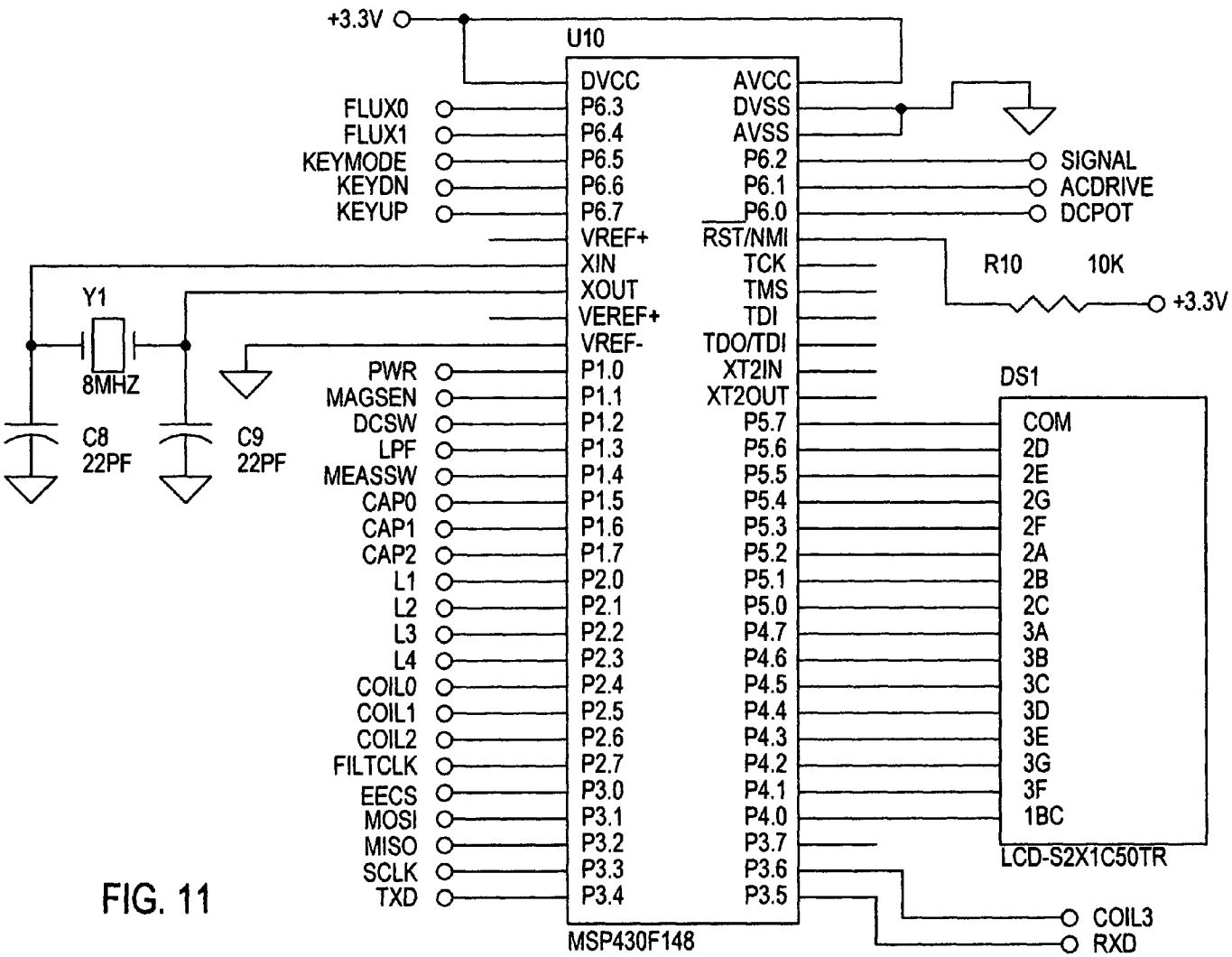
FIGS. 11-21 are a schematic representation of the circuit of the preferred embodiment of the handheld pickup measurement device.

Starting with FIG. 11, the microcontroller (U10, and reference numeral 200 in the preceding) controls all functions of the device including the measurements, user interface, and data storage. It is a conventional microcontroller with onboard RAM, FLASH EEPROM, peripheral I/O, and 12-bit analog to digital converter. Connected to the microcontroller is display DS1, a two and one half digit numeric liquid crystal display. The microcontroller displays numbers and some alpha characters as needed to execute the user interface display. The microcontroller provides most of the signals that control the hardware in the remaining sections of the schematic.

Figure 12:
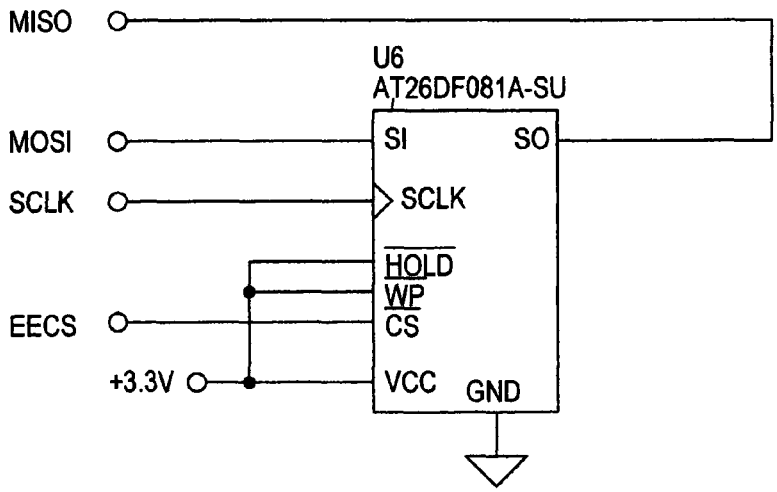

Referring to FIG. 12, a data storage memory (U6) can hold some hundreds of response curves and associated measurements and is a common SPI bus serial memory device.

Figure 13:
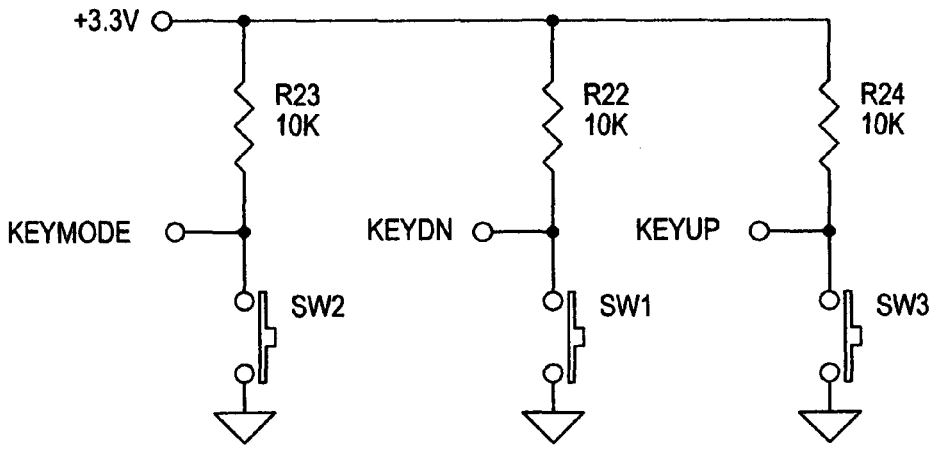

Referring to FIG. 13, three pushbutton switches are shown and these comprise the user input interface of the measurement device. Switch SW2 serves as a mode selection button, cycling through several operational modes, including selection of passive vs. active pickup type, in-instrument vs. naked pickup measurement mode, and others as detailed previously. Within each mode, key switches SW1 and SW3 function as up/down selectors for each option.

Figure 14:
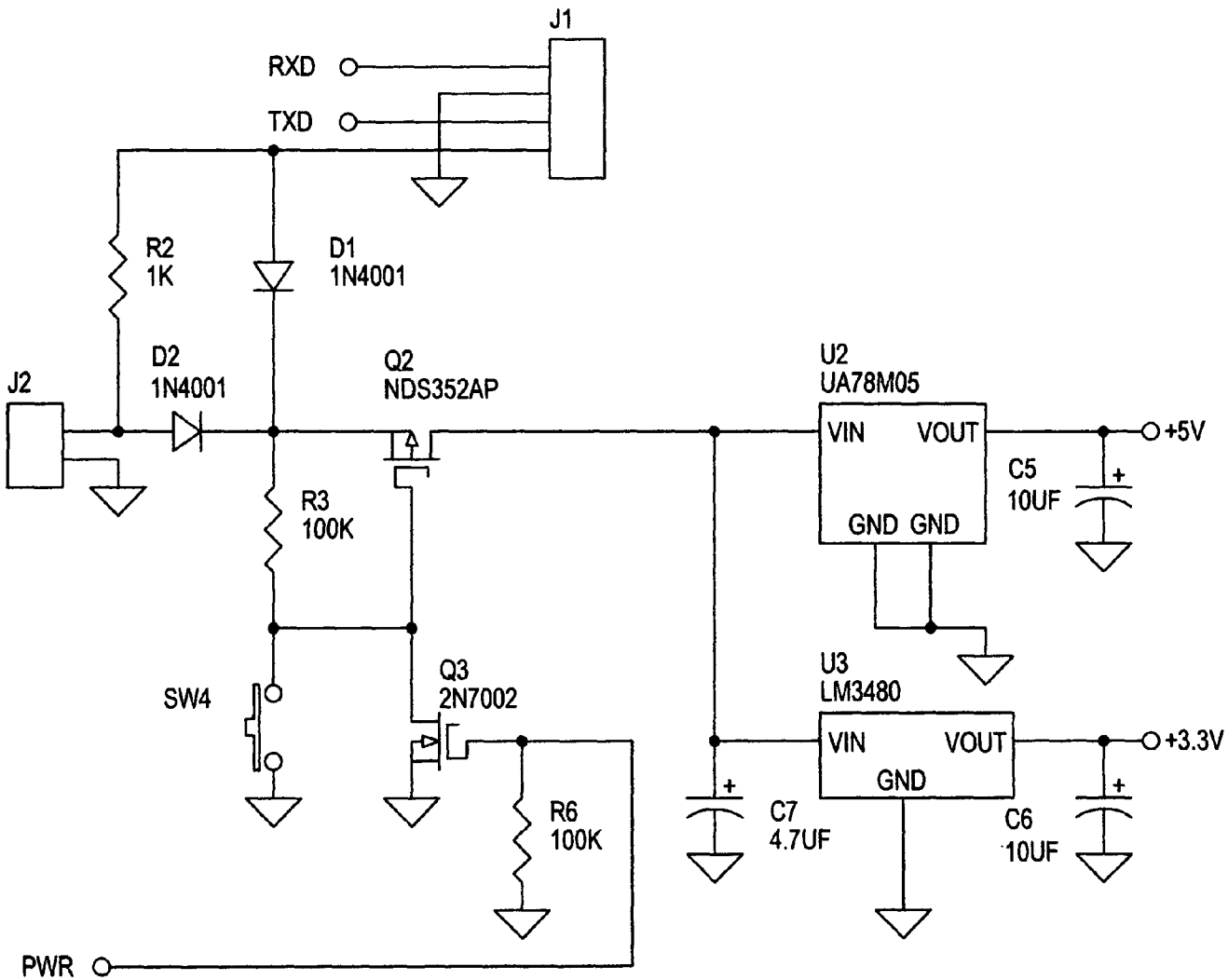

Referring to FIG. 14, the power conditioning circuitry is shown. A nine-volt NiMH rechargeable battery is typically connected at connector J2. This battery is trickle charged through resistor R2 when a charger is connected to connector J1. A pushbutton switch SW4 may be pressed by the user to power the measurement device, and, once powered, microcontroller U10 activates the PWR signal to keep power on until the user depowers the unit via the user interface. Common voltage regulators U2 and U3 provide regulated voltages to the remainder of the circuitry. Data communication to an external system is accomplished with a simple wired connection from J1 to the serial data lines on the microcontroller U10, RXD and TXD. An external interface circuit allows this device to be connected to a personal computer for download of collected data.

Figure 15:
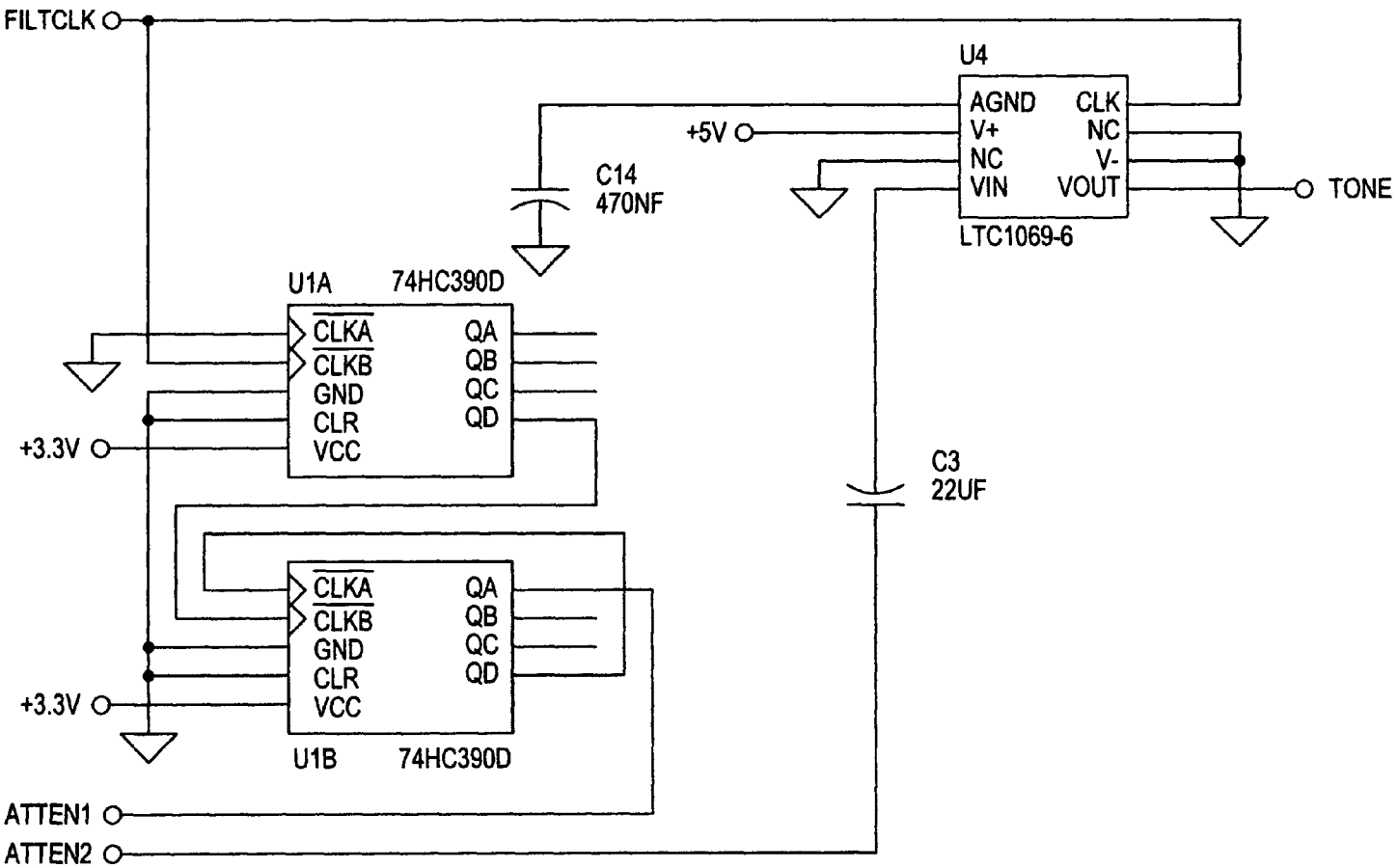

Referring to FIG. 15, the first section of the tone generation circuitry is shown. The tone generated must be stable in amplitude and frequency, and digitally tunable over a large three-decade range. This is accomplished using a digitally generated square wave of precise frequency, and a digitally tuned switched capacitor lowpass filter to convert it into a sine wave. The microcontroller U10 generates a square wave at 50 times the desired tone frequency on a signal FILTCLK, using counters internal to the microcontroller. This clock drives a switched capacitor lowpass filter U4, whose cutoff frequency is one-fiftieth the clock frequency. A divide by 50 counter U1 takes FILTCLK and produces a square wave which is fed through an attenuator into the filter U4, producing a clean sinusoidal output, TONE. An electronic attenuator is used to control the amplitude of the square wave input to filter U4, through signals ATTEN1 and ATTEN2.

Figure 16:
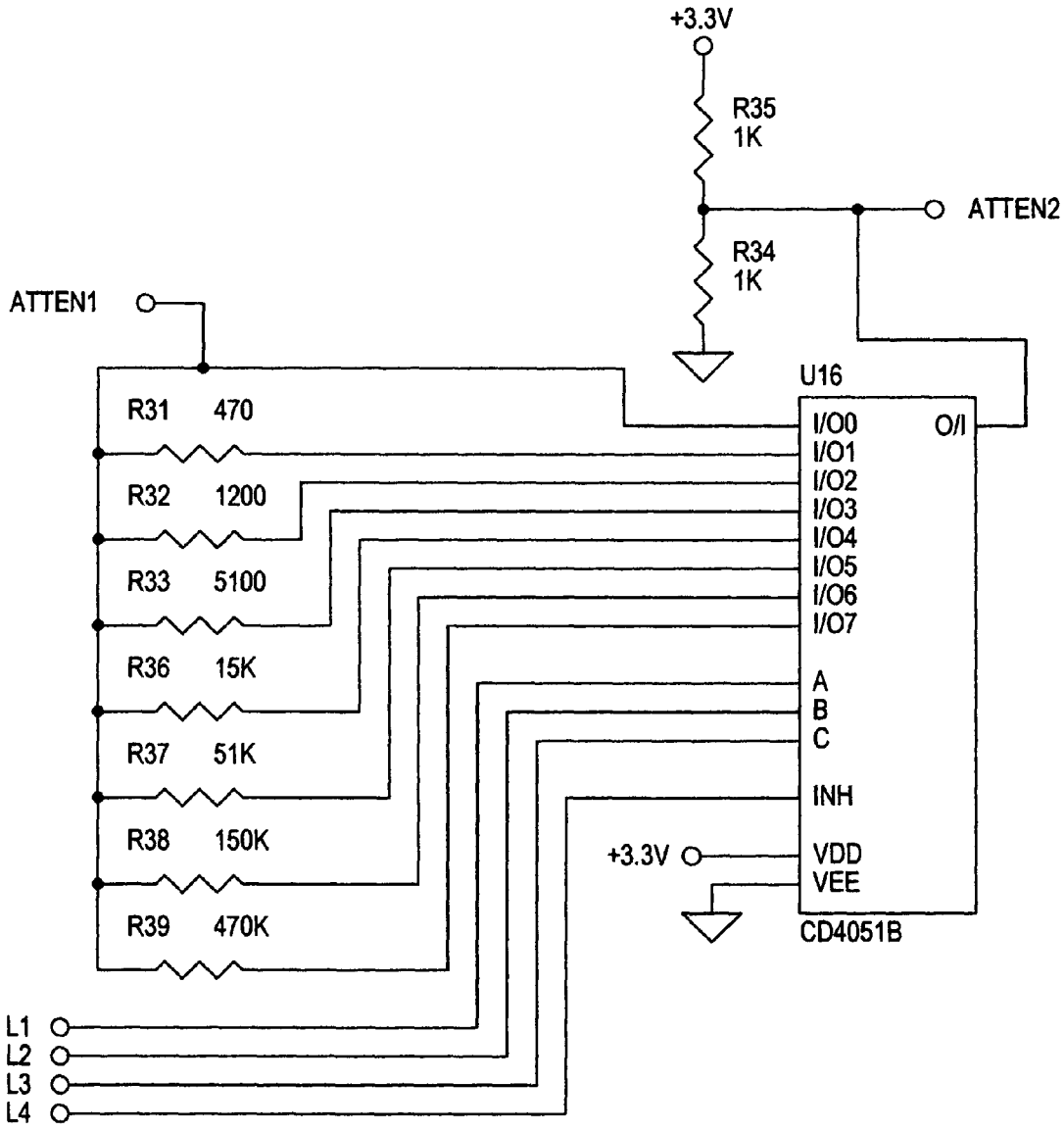

Referring to FIG. 16, the attenuator circuit is shown. The square wave at the fundamental frequency is supplied from FIG. 15 on ATTEN1. This is connected to an attenuator fashioned from an analog switch array U16 and several resistors, R31-33, R36-39. The microcontroller U10 selects which resistor is connected using level control signals L1-L4. The selected resistor, in conjunction with resistors R34 and R35 effect a stepped variable attenuator. The attenuated square wave signal is sent back to the switched capacitor lowpass filter U4 as ATTEN2. Note that one of the settings of signals L1-L4 disables the signal entirely, resulting in no tone output from filter U4. The attenuator is required because the gain profile of a pickup can vary by tens of decibels, and an optimum signal level is required to get a good signal to noise ratio and avoid clipping.

Figure 17:
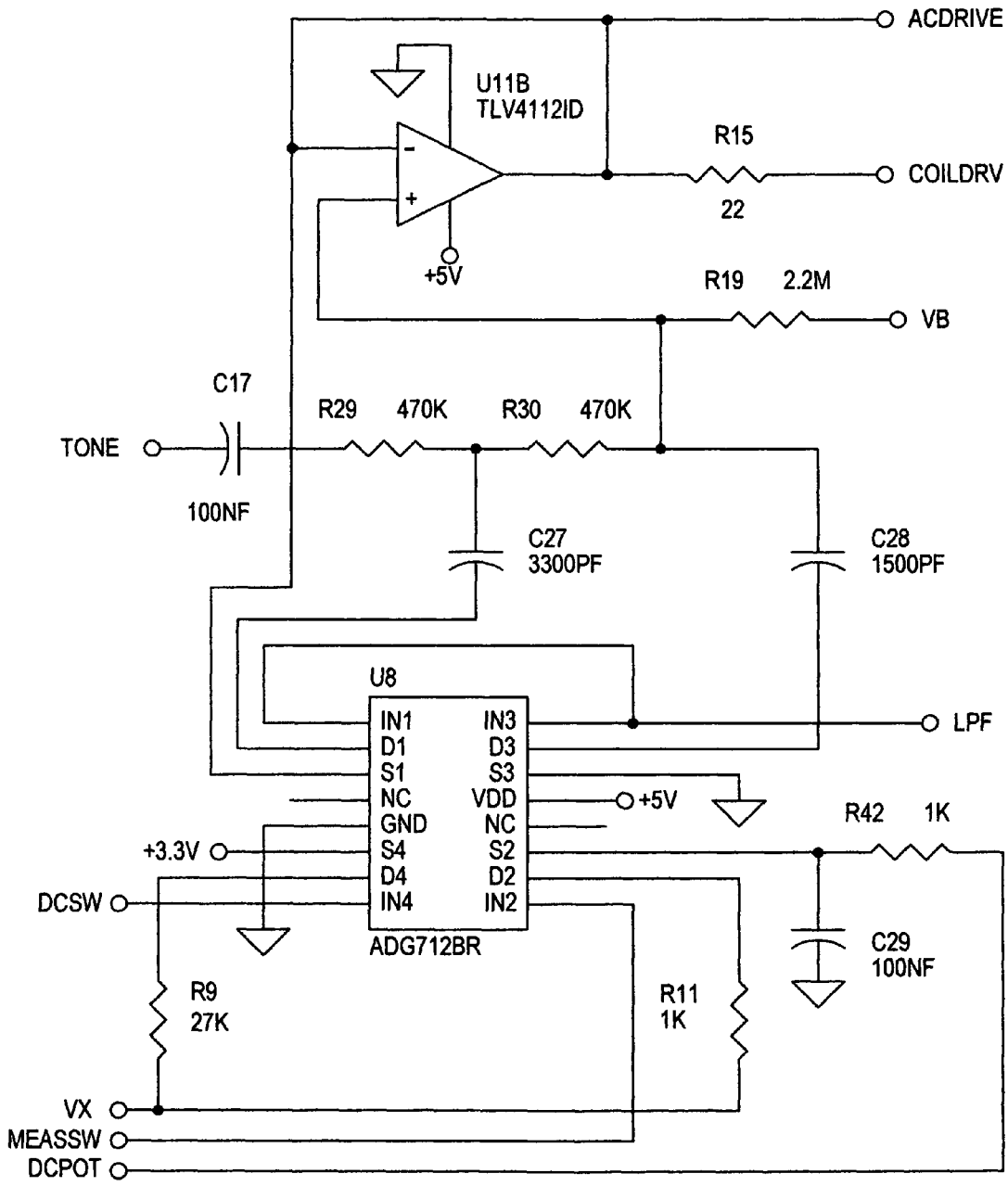

Referring to FIG. 17, the sinusoidal TONE signal arrives from switched capacitor lowpass filter U4 and is processed by a circuit whose function is to provide analog lowpass filter attenuation of residual clock noise from the switched capacitor filter U4, and a low output impedance suitable for driving the excitation coil(s). Amplifier U11B is a high current capacity amplifier run in voltage follower mode. However, an analog switch U8 is connected in concert with components R29, R30, C27, and C28 to create a selectable unity gain Sallen-Key lowpass filter with a cutoff frequency of approximately 150 Hz. The signal LPF from microcontroller U10 selects this operation, or no lowpass response (flat response).

The output from amplifier U11B is sent to the microcontroller U10 for amplitude monitoring as signal ACDRIVE, and to excitation coil switching circuitry as COILDRV, through current limiting resistor R15. Bias for amplifier U11B is provided through resistor R19 by a half-supply DC voltage, VB.

The remainder of the circuitry on FIG. 17 will be discussed in relation to DC resistance measurement shortly.

Figure 18:
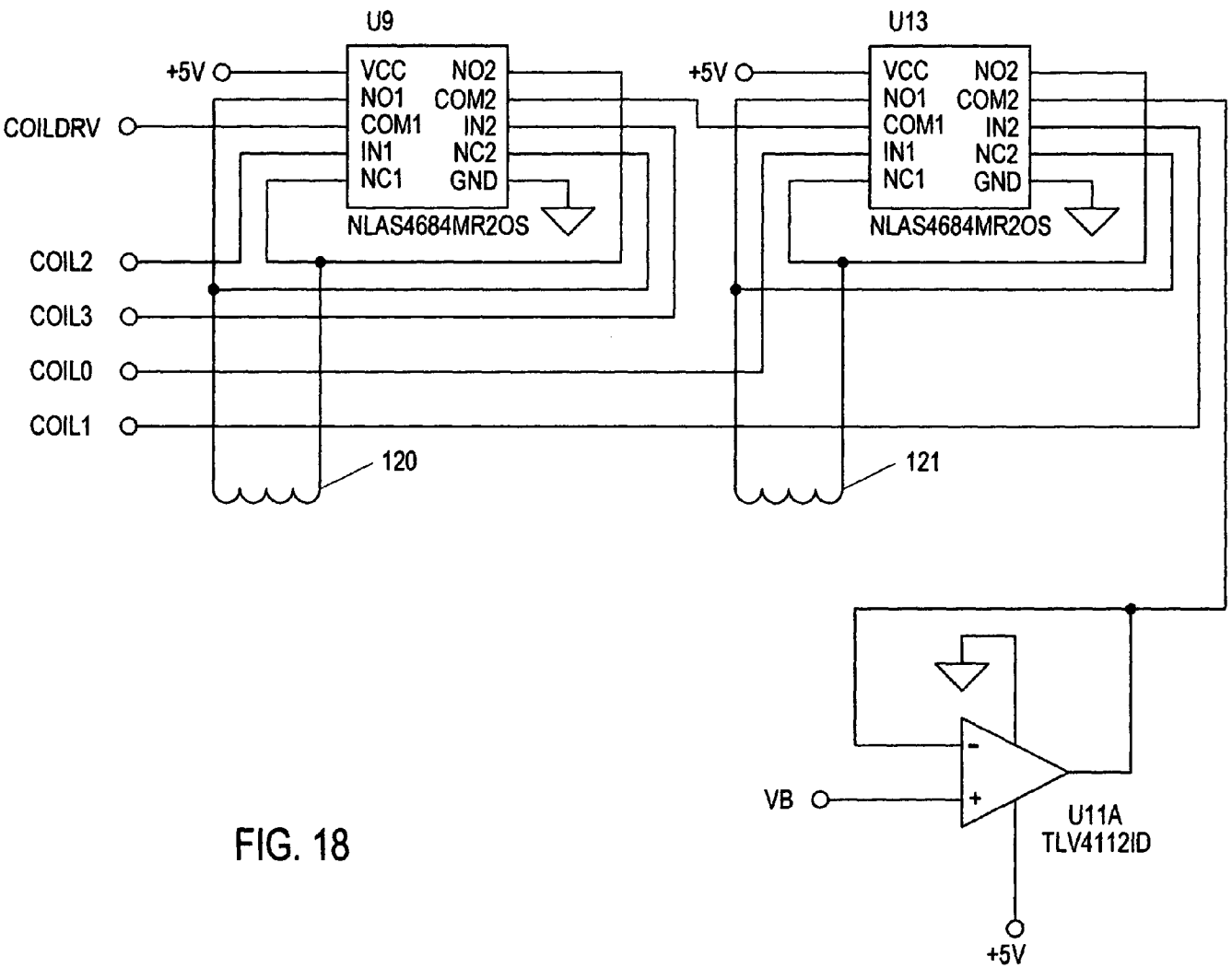

Referring to FIG. 18, two low resistance switches U9 and U13 are used to route the COILDRV signal to one or both of the excitation coils 120 and 121, both printed circuit board traces. These switches, dual single pole double throw types, are controlled by signals COIL1-COIL4 from microcontroller U10. The wiring of the switches allows the coils to be connected singly or in series, with reversible polarity as test conditions require. Since amplifier U11B was biased at half supply (VB), the other end(s) of the coil(s) must be terminated in that voltage to avoid quiescent DC currents from flowing through the excitation coils. This is accomplished using amplifier U11A, which is connected as a voltage follower and biased at VB.

Figure 19:
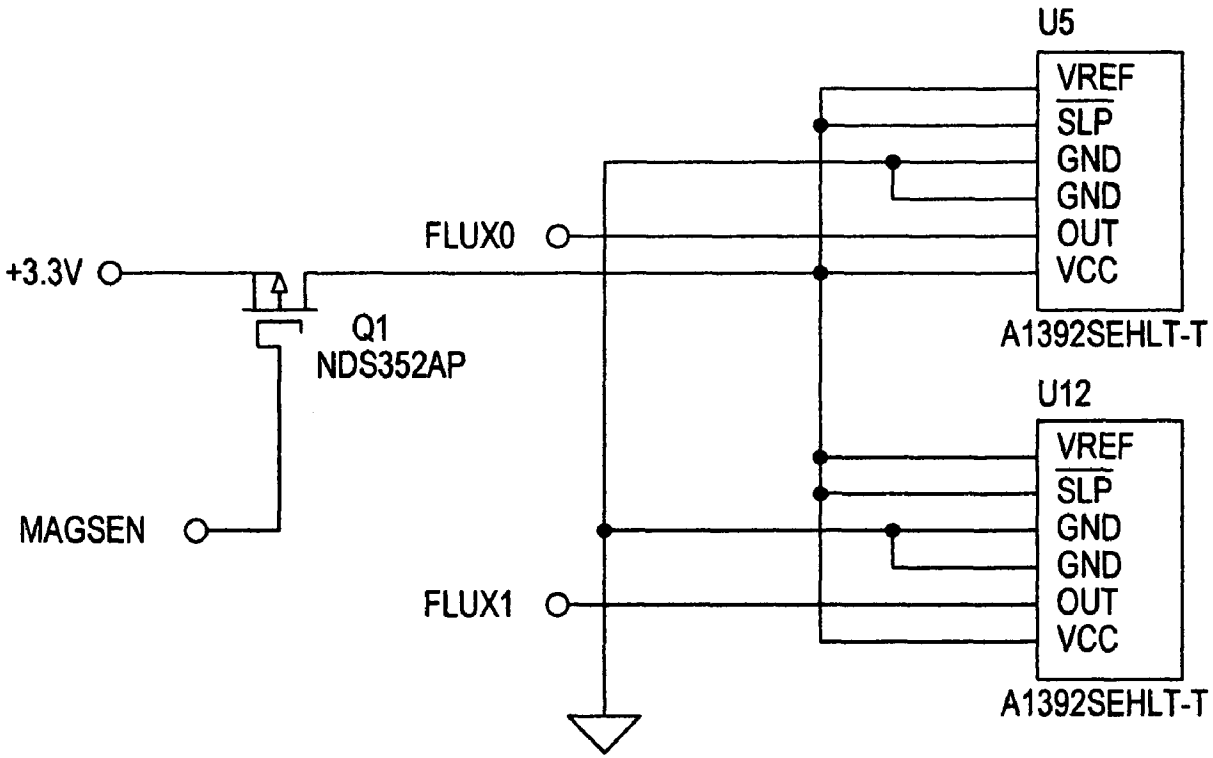

Referring to FIG. 19, the magnetic sensors are shown, U5 and U12. These are Hall effect devices. They are powered off when not in use to conserve battery energy, using signal MAGSEN (from microcontroller U10) and a transistor Q1. The analog voltages FLUX0 and FLUX1 are sent to microcontroller U10 for analog to digital conversion, and these signals indicate the level and polarity of magnetic field near the sensors, generated by the magnets of the pickup under test.

Figure 20:
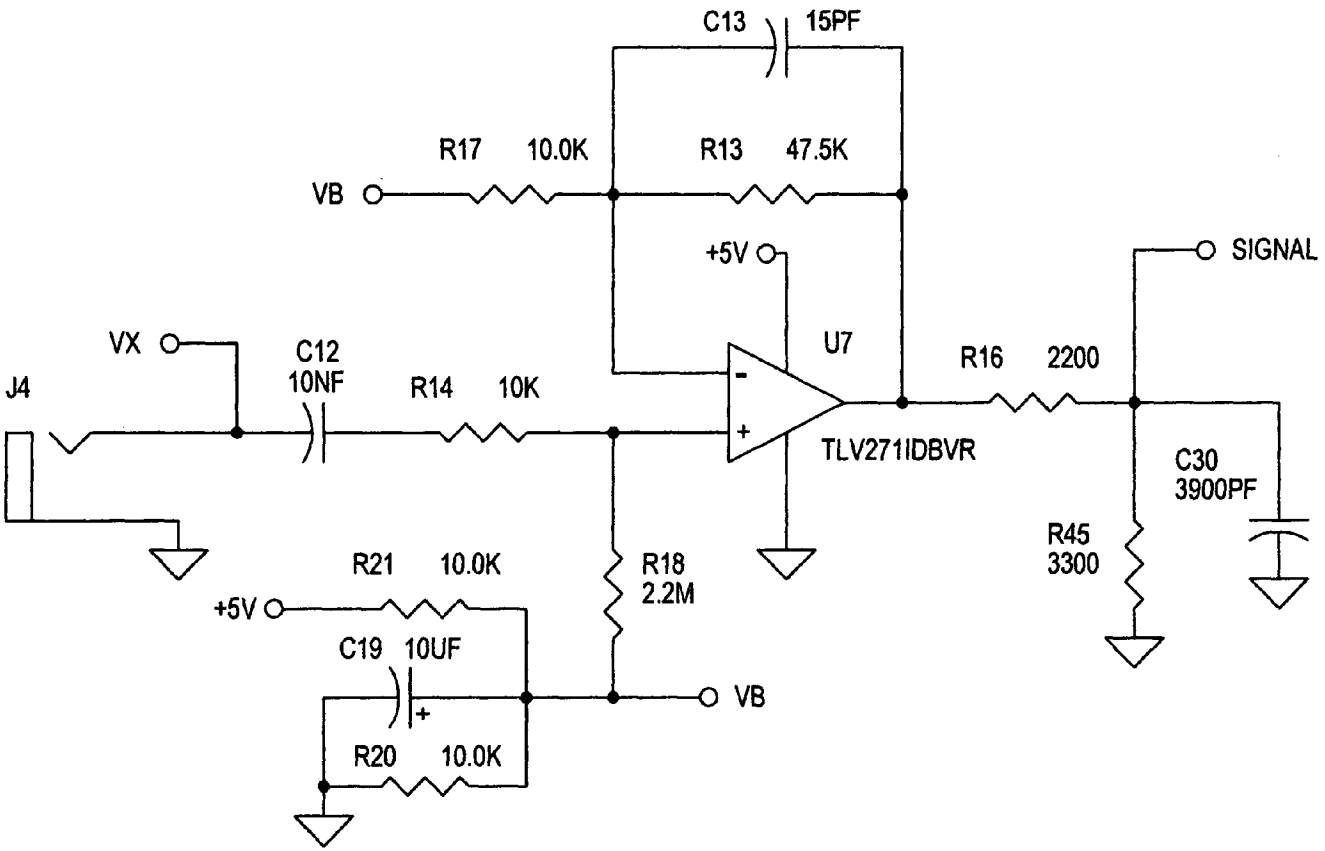

Referring to FIG. 20, an audio amplifier is shown that amplifies the signal from the pickup, connected to the measurement device through a jack J4 (also referred to as reference numeral 206). This is a conventional operational amplifier circuit (U7) with high gain to allow easy measurement of the pickup signal by the microcontroller U10 analog to digital converter. Resistor divider R16-R45 prevents the amplified signal SIGNAL from exceeding the 3.3 VDC supply of microcontroller U10. Capacitor C30 provides a 31 KHz lowpass roll off of any high frequency noise coming from the pickup. The amplifier is biased at half supply by signal VB, which is generated using a simple voltage divider R20-R21. Note also that the pickup loading conditions and DC measurement circuits are connected directly to the audio jack J4 at signal VX.

Figure 21:
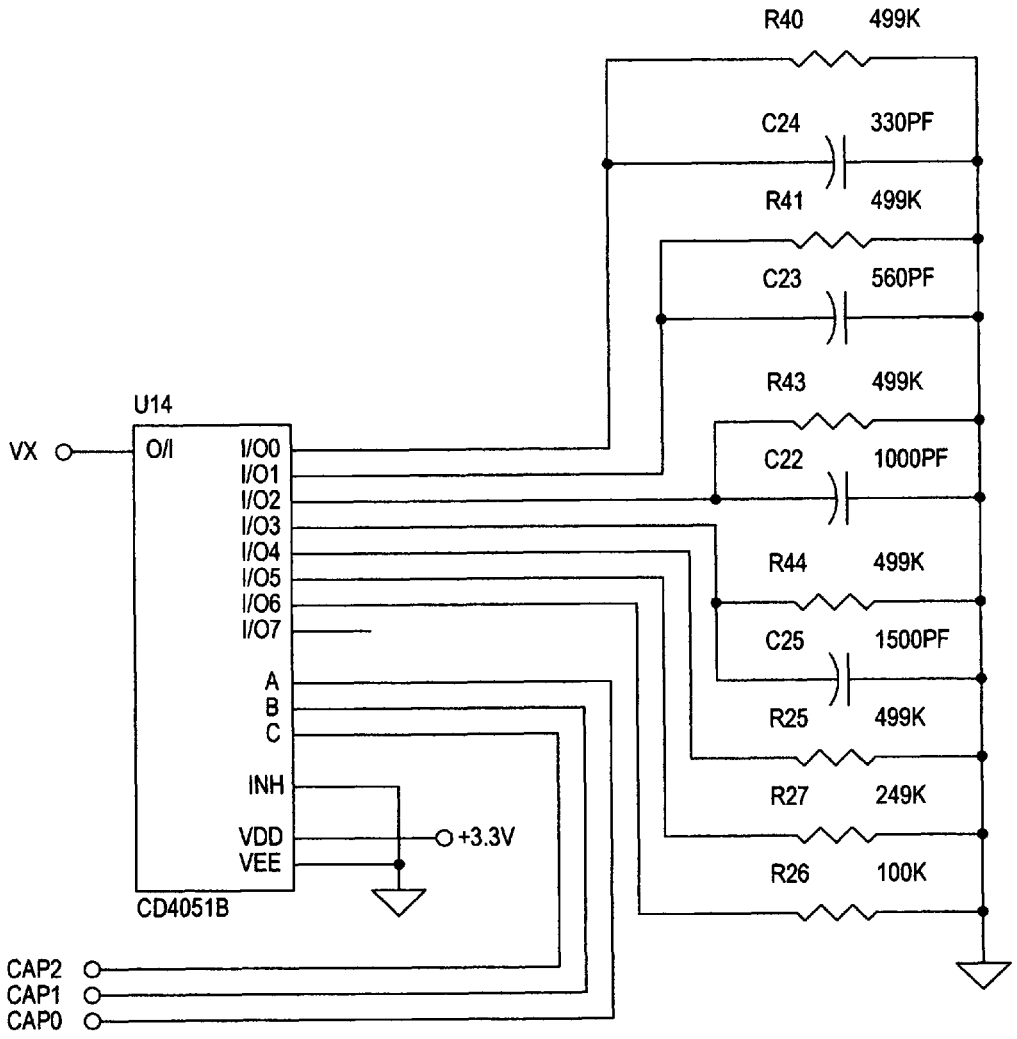

Referring to FIG. 21, an analog switch array U14 is used to switch in various loads (or none at all) to signal VX and by cable connection to the pickup under test. Signals CAP0-

CAP2 from microcontroller U10 select which load to connect. Various resistive and capacitive loads are part of the standard pickup test and simulate various potentiometer resistances and cable capacitances (cable lengths).

Referring again to FIG. 17, analog switch U8 also participates in the DC measurements of the pickup. To measure the resistance of the pickup, a signal DCSW is used to connect 3.3 VDC to resistor R9, which is in turn connected to VX, the pickup under test. Signal MEASSW is used to connect the signal VX through protection and filtering components R11, R42, and C29, to an analog input of microcontroller U10 via a signal DCPOT, for measuring of the resulting voltage drop and computation of the pickup and possibly potentiometer resistance.

Not shown on the schematics are customary circuits such as power supply bypass capacitors and electrostatic discharge protection. These are included as a matter of course and good practice in any embodiment.

Use of the Measurement Device

Figure 22:
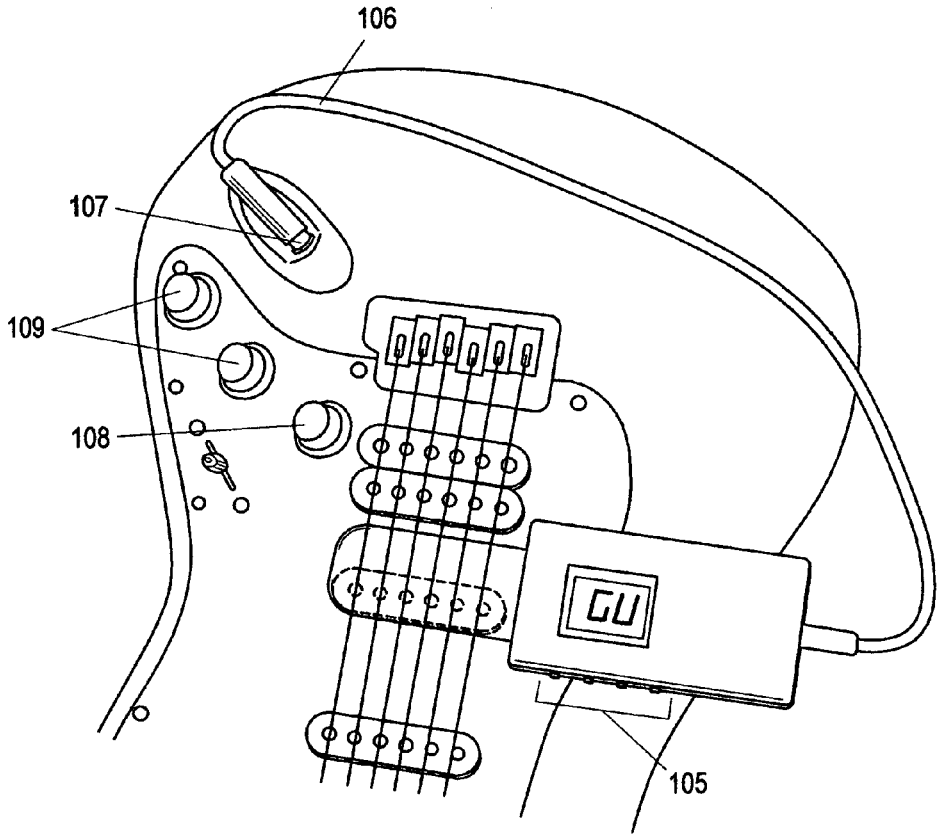
FIG. 22 is a sketch of the handheld pickup measurement device being used to measure the characteristics of a single coil pickup.

FIG. 22 is a sketch of the handheld pickup measurement device being used to measure the characteristics of a single coil pickup in an instrument. In this case, the operator uses the keypad 105 to select in-guitar, passive pickup measurement mode, and the memory storage address for measured data. Next he plugs the audio cable 106 into the guitar's audio jack 107, so the measurement device can sample the pickup response. Next he initiates the measurement process using the keypad, and the measurement device starts sampling the magnetic sensors 150 and 151 (not shown) looking for a nearby pickup. Once found, the display shows whether a dual or single coil pickup has been detected, by displaying a number (1 or 2) or graphical bars. The display also shows the relative strength of the magnetic field to aid in centering the excitation coils and sensors over the pickup.

When the measurement device determines that the magnetic field is stable (implying that the measurement device is being held still), it starts the resistance measurement process, prompting the operator to slowly vary the instrument's volume control 108 to maximize the number displayed, and this maximum occurs when the volume control is adjusted to some mid-scale value such that the resistance of the volume control and pickup combination are a maximum. The measurement is stored by the microcontroller and the operator is then prompted to increase the volume control to maximum setting, where another measurement is made, allowing computation of the volume control and pickup DC resistances.

Next, the tone generator begins its sweep, and the microcontroller records the amplitude of signal coming from the guitar through the audio cable, adjusting the level of the tone as needed to get a good measurement.

One tone sweep is performed for each loading condition, and the data is stored for later retrieval. The sweep frequency range is typically 20 Hz to 20 KHz, but could be greater or lesser depending on the data required.

Note that the guitar's tone controls 109 are set to the setting that has the least high frequency roll off, so that the response measured is not biased by them.

Figure 23:
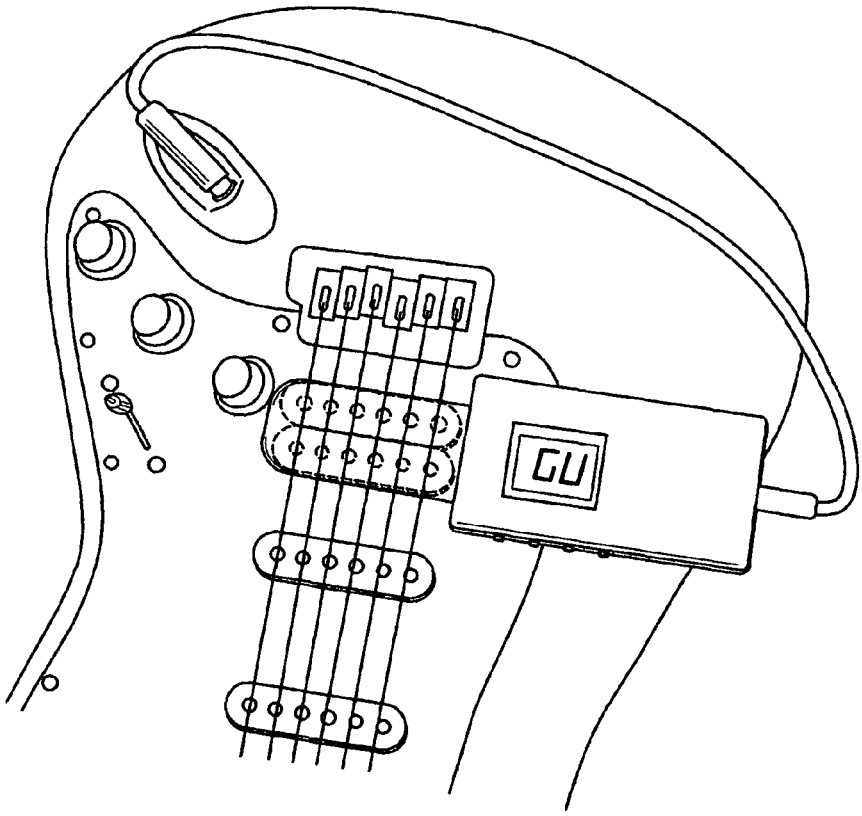
FIG. 23 is a sketch of the handheld pickup measurement device being used to measure the characteristics of a dual coil pickup.

FIG. 23 is a sketch of the handheld pickup measurement device being used to measure the characteristics of a dual coil pickup. In this case, all measurement activities are identical to the single coil case except that both excitation coils are energized. The measurement device automatically detects the presence of two sets of magnetic pole pieces in the pickup and configures the test accordingly.

CONCLUSION

Dissemination of data collected with this invention, after the filing of U.S. Provisional Application No. 61/211,616, has resulted in positive comments from musicians and pickup manufacturers regarding the usefulness of this tool. Nearly 7,000 individual requests for pickup response presentations were recorded over a six-month period, and that is with very little promotion of the tool to the musical community. Users have been surprised at the utility and unexpected usefulness of the aural comparisons in particular.

Prior to this invention, there has been no way to quickly compare the sounds of magnetic pickups. The little technical data that has been disseminated by manufacturers has been seen as only a crude indicator of pickup sound. And other efforts, such as those of Keene and Errede, while technically capable of determining the parameters controlling pickup sound, simply do not make comparisons accessible to the musician. The present invention is not simply a combination of old elements, but rather a new system of measurement and presentation that opens up a whole new world for musicians seeking better sound.

While the thrust of this description has been to inform a pickup buyer's decision-making process, the techniques herein also are useful to pickup manufacturers who are tuning their pickups in the design process, or presenting them to potential customers.

The specific configuration of the embodiments discussed should not be construed to limit implementation of the handheld pickup measurement device to those embodiments only. The techniques outlined are applicable to embodiments in other physical formats, using various power sources, using various electronic amplifier and signal generator topologies, and using various ways in which to couple the excitation signal to the pickup under test. Other embodiments may use analog or digital processing techniques, and/or implement or simulate or emulate the invention substantially in software or digital hardware after characterizing the pickup under test in terms of equivalent circuits, or one- or two-port parameters. Therefore, the scope of the invention should be determined not by the embodiments illustrated, but by the appended claims and their legal equivalents.

What is claimed is:

1. A method for measuring and presenting a frequency response of a magnetic pickup, and presenting for comparison said frequency response of said magnetic pickup against previously recorded frequency responses of previously measured magnetic pickups, comprising of the steps of (a) connecting electrically to said magnetic pickup one of several selectable load circuits; and (b) placing an excitation coil having an inductance less than 1% of the inductance of said magnetic pickup in proximity to said magnetic pickup; and (c) driving said excitation coil with an excitation signal whereby said magnetic pickup is excited with a magnetic field generated by said excitation coil; and (d) measuring and recording a frequency response of said magnetic pickup in response to said excitation signal; and (e) measuring and recording a resistance of said magnetic pickup, and a resistance of a musical instrument volume control if present; and (f) presenting graphically said recorded frequency response of said magnetic pickup, and presenting for graphical comparison zero or more said previously recorded frequency responses of said previously measured magnetic pickups; and (g) presenting said recorded frequency response of said magnetic pickup for aural playback by filtering a reference audio clip using said recorded frequency response of said magnetic pickup, and playing the resultant audio; and (h) presenting numerically said recorded resistance of said magnetic pickup, and said recorded resistance of said musical instrument volume control if present, whereby said recorded resistance of said magnetic pickup and said recorded resistance of said musical instrument volume control are used to understand gain and resonance characteristics exhibited in said recorded frequency response of said magnetic pickup.

2. The method of claim 1, where said excitation signal is selected from the group consisting of a sinusoid of swept frequency and a sinusoid of stepped frequency and broadband noise.

3. The method of claim 1, where said reference audio clip is selected from the group consisting of a prerecorded audio clip and an audio clip supplied by the consumer of the presentation.

4. A measurement device for measuring and communicating a frequency response of a magnetic pickup comprising (a) a loading means electrically connectable to the electrical output signal of said magnetic pickup, providing selectable load circuits, any one of said selectable load circuits connectable for the duration of measurement of said frequency response; and (b) an excitation coil means of inductance less than 1% of the inductance of said magnetic pickup, magnetically coupleable to said magnetic pickup by proximate placement; and (c) an excitation signal generating means for driving said excitation coil means with an excitation signal; and (d) a frequency response measuring means for measuring said frequency response of said magnetic pickup in response to said excitation signal, electrically connectable to said electrical output signal of said magnetic pickup; and (e) a resistance measuring means for measuring a resistance of said magnetic pickup, and for measuring a resistance of a musical instrument volume control if present, whereby said recorded resistance of said magnetic pickup and said recorded resistance of said musical instrument volume control are used to understand gain and resonance characteristics exhibited in said recorded frequency response of said magnetic pickup; and (f) a recording means for recording said measured frequency response, said resistance of said magnetic pickup, and said resistance of said musical instrument volume control if present; and (g) a communication interface means for communicating the recorded contents of said recording means to an external presentation means.

5. The measurement device of claim 4, where said excitation coil means is connected through a coil switching means to said excitation signal generating means, with a magnetic sensor means disposed on said excitation coil means, said magnetic sensor means providing a signal to said coil switching means indicating a single coil or double coil structure of said magnetic pickup, said coil switching means using said signal to connect said excitation coil to match said single coil or double coil structure of said magnetic pickup.

6. The measurement device of claim 5, where said magnetic sensor means provides also a magnetic polarity signal and a magnetic strength signal of the magnetic field of said magnetic pickup, said magnetic polarity signal and said magnetic strength signal also recorded by said recording means.

7. The measurement device of claim 6, where said magnetic strength signal is provided to a display means disposed on said measurement device, whereby said excitation coil means may be centered over said magnetic pickup by maximizing said magnetic strength signal.

8. The measurement device of claim 4, where said excitation signal is selected from the group consisting of a sinusoid of swept frequency and a sinusoid of stepped frequency and broadband noise.

9. The measurement device of claim 4, where an amplitude of said electrical output signal of said magnetic pickup is provided to a display means disposed on said measurement device, displaying the amplitude of said electrical output signal, whereby said excitation coil means may be centered over said magnetic pickup by maximizing said amplitude of said electrical output signal.

10. The measurement device of claim 4, where said excitation coil means is no more than 0.25 cm thick.

11. The measurement device of claim 4, where said loading means provides selectable resistive and capacitive load circuits electrically connectable to said magnetic pickup output signal during operation of said frequency response measuring means.

12. The measurement device of claim 4, also having the structure of a handheld, portable device, with means for communication, encryption and authentication of contents of said recording means to an external computer system for storage and presentation.

13. The measurement device of claim 4, where said recording means includes a voice notepad audio recorder, whereby the identifying details of said magnetic pickup may be recorded vocally.

14. The measurement device of claim 4, where said recording means includes a camera, whereby a photograph of said magnetic pickup may be recorded.

15. The measurement device of claim 4, including also a user input interface means and a display means, both disposed on said measurement device, whereby an operator selection may be made whether said magnetic pickup being measured is wired to a musical instrument containing a volume control whose resistance must be measured, or is being measured independent of a musical instrument where no volume control is present.

16. The measurement device of claim 15, where said display means displays operator prompts, whereby said prompts are provided to an operator to adjust said musical instrument volume control if present to facilitate measurement of said resistance of said magnetic pickup and said resistance of said musical instrument volume control.

* * * * *